US010085608B2

(12) United States Patent
Kim et al.

(10) Patent No.: US 10,085,608 B2
(45) Date of Patent: Oct. 2, 2018

(54) ROBOT CLEANER

(71) Applicant: LG ELECTRONICS INC., Seoul (KR)

(72) Inventors: Kihyung Kim, Seoul (KR); Seunghyun Woo, Seoul (KR); Kichu Hong, Seoul (KR); Seonghak Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 76 days.

(21) Appl. No.: 15/107,139

(22) PCT Filed: Dec. 23, 2013

(86) PCT No.: PCT/KR2013/012009
§ 371 (c)(1),
(2) Date: Jun. 22, 2016

(87) PCT Pub. No.: WO2015/099205
PCT Pub. Date: Jul. 2, 2015

(65) Prior Publication Data

US 2016/0316982 A1 Nov. 3, 2016

(51) Int. Cl.
*A47L 9/28* (2006.01)
*A47L 11/40* (2006.01)
*A47L 9/30* (2006.01)

(52) U.S. Cl.
CPC ..... *A47L 11/4011* (2013.01); *A47L 9/2857* (2013.01); *A47L 9/30* (2013.01);
(Continued)

(58) Field of Classification Search
CPC ..... A47L 9/30; A47L 9/2857; A47L 11/4011; A47L 11/4013; A47L 11/4005;
(Continued)

(56) References Cited

U.S. PATENT DOCUMENTS 6,774,596 B1 8/2004 Bisset
2007/0267570 A1 11/2007 Park et al.
(Continued)

FOREIGN PATENT DOCUMENTS

DE 20 2010 006 456 8/2010
JP S 36-004667 3/1961
(Continued)

OTHER PUBLICATIONS

International Search Report dated Sep. 23, 2014 issued in Application No. PCT/KR2013/012009.
(Continued)

*Primary Examiner* — David Redding
(74) *Attorney, Agent, or Firm* — KED & Associates, LLP

(57) ABSTRACT

The present invention provides a robot cleaner comprising: a main body which forms an outer appearance; a driving unit for moving the main body; a cleaning unit, installed at the lower portion of the main body, for sucking filth or dust on a floor surface or in the air; light emitting units which are installed at the lower portion of the main body and configured to externally emit light according the driving condition of the driving unit; and a controller for controlling the plurality of light emitting units so that the light emitting units emit light in forms different from each other according to each of a first driving condition where the main body is stopped, a second driving condition where the main body moves, and a third driving condition where the main body rotates.

14 Claims, 17 Drawing Sheets

(52) U.S. Cl.
CPC ..... *A47L 11/4005* (2013.01); *A47L 11/4013* (2013.01); *A47L 2201/00* (2013.01); *A47L 2201/022* (2013.01); *A47L 2201/04* (2013.01)

(58) Field of Classification Search
CPC ..... A47L 2201/04; A47L 2201/022; A47L 2201/00; A47L 9/28
See application file for complete search history.

(56) References Cited

U.S. PATENT DOCUMENTS

| | | | |
|---|---|---|---|
| 2010/0049364 | A1 | 2/2010 | Landry et al. |
| 2013/0231819 | A1 | 9/2013 | Hung et al. |

FOREIGN PATENT DOCUMENTS

| | | | |
|---|---|---|---|
| JP | S 53-093142 | | 7/1978 |
| JP | H 07-046710 | | 2/1995 |
| JP | H 10-075921 | | 3/1998 |
| JP | H 11-176233 | | 7/1999 |
| JP | 2003-501120 | | 1/2003 |
| JP | 2004-148088 | | 5/2004 |
| JP | 2004-159736 | | 6/2004 |
| JP | 2006-313455 | | 11/2006 |
| JP | 2007-334667 | | 12/2007 |
| JP | 2009-104835 | | 5/2009 |
| JP | 2009-518074 | | 5/2009 |
| JP | 2010-102891 | | 5/2010 |
| JP | 2010-272358 | | 12/2010 |
| JP | 2013-146312 | | 8/2013 |
| KR | 10-0722762 | B1 | 5/2007 |
| KR | 10-2013-0015787 | A | 2/2013 |
| KR | 10-1233158 | B1 | 2/2013 |
| KR | 10-2013-0137536 | A | 12/2013 |

OTHER PUBLICATIONS

European Search Report dated Jul. 18, 2017 issued in Application No. 13900400.6.

Japanese Office Action dated Oct. 3, 2017 issued in Application No. 2016-542228.

ROBOT CLEANER

CROSS-REFERENCE TO RELATED PATENT APPLICATIONS

This application is a U.S. National Stage Application wider 35 U.S.C. § 371 of PCT Application No. PCT/KR2013/012009, filed Dec. 23, 2013, whose entire disclosures are hereby incorporated by reference.

BACKGROUND OF THE DISCLOSURE

1. Field of the Disclosure

The present disclosure relates to a robot cleaner including light emitting units for emitting light.

2. Background of the Disclosure

In general, robots have been developed for industrial use and taken charge of a part of factory automation. In recent years robot application fields have been further expanded, and medical robots, aerospace robots, and the like have been developed, and household robots that can be used at homes have been also made.

A representative example of the household robot is a robot cleaner, which is a type of electronic device for sucking and cleaning surrounding dust and foreign substances while traveling a predetermined region by itself. The robot cleaner may typically include a rechargeable battery, and include an obstacle sensor capable of avoiding obstacles while traveling to travel and clean by itself.

On the other hand, for a method of controlling the robot cleaner, there are a method of using a remote control that is a user interface, a method of using a button provided in a robot cleaner body, and the like.

In recent years, application technologies using the robot cleaner have been developed. For example, the development of a robot cleaner having a networking function have been carried out to implement a function capable of sending a cleaning command from a remote place or monitoring house conditions. Furthermore, robot cleaners having a self position recognition and mapping function using a camera or various sensors have been developed.

However, as various functions of a robot cleaner are implemented, there is a drawback causing difficulty to know the status of the robot cleaner while traveling and moving without a user's control command.

SUMMARY OF THE DISCLOSURE

Accordingly, the task of the present disclosure is to provide a robot cleaner having a light emitting unit for notifying its driving conditions.

In order to accomplish the task of the present disclosure, a robot cleaner according to an embodiment of the present disclosure may include a main body configured to form an outer appearance, a driving unit configured to move the main body, a cleaning unit provided at a lower portion of the main body to suck filth or dust on a floor surface or in the air, a plurality of light emitting units provided at a lower portion of the main body, and formed to emit light to an outside according to a driving condition of the driving unit, and a controller configured to control the plurality of light emitting units to emit light in a different form according to a first driving condition in which the main body stops, a second driving condition in which the main body moves, and a third driving condition in which the main body rotates, respectively.

According to an example associated with the present disclosure, each of the light emitting units may include a light emitting portion formed to emit at least one color light by the controller, a support portion formed to surround the light emitting portion, and formed of a transparent material to transmit the light therethrough, and a reflector formed in a partial region of an inner surface of the support portion to have an opening portion to reflect light toward a lower portion thereof.

According to an example associated with the present disclosure, an angle between both ends of the opening portion around the light emitting portion may be formed to be less than 90 degrees.

According to an example associated with the present disclosure, an angle between a first line connecting from the light emitting portion to one end of the opening portion and the ground that supports the main body may be formed to be greater than 90 degrees.

According, to an example associated with the present disclosure, an angle between a second line connecting from the light emitting portion to the other end of the opening portion and the ground that supports the main body may be formed to make a preset angle.

According to an example associated with the present disclosure, the controller may move the reflector along an inner surface of the support portion to change a region on which the light is reflected.

According to an example associated with the present disclosure, the reflector may include a plurality of reflective members formed along an outer circumferential surface of the main body, and the controller may control the plurality of reflective members to move to different positions based on the driving condition.

According to an example associated with the present disclosure, the light emitting portion may include a plurality of light emitting members formed along the reflector, and the controller may activate the plurality of light emitting members in different manners based on the driving condition.

According to an example associated with the present disclosure, the plurality of light emitting portions may be formed along an outer circumference of the main body, and the controller may define a direction in which the main body moves in the second driving condition as a front portion and a region separated from the front portion as a rear portion, and the controller may activate a light emitting portion formed, in at least one region of the front portion and the rear portion.

According to an example associated with the present disclosure, the plurality of light emitting portions may be formed along an outer circumference of the main body, and the controller may define one of the plurality of light emitting portions as a reference light emitting unit in the second condition, and sequentially activate the light emitting portions along the one direction from the reference light emitting portion.

According to an example associated with the present disclosure, the controller may control the light emitting unit to change a brightness of light emitted from the light emitting unit according to the flow of time.

According to an example associated with the present disclosure, the controller may control the plurality of light emitting units to emit light formed in a predetermined pattern in any one of the first through the third driving condition.

According to an example associated with the present disclosure, the predetermined pattern may be formed in a wave shape moving in a direction away from or closer to an outer circumference of the main body.

According to an example associated with the present disclosure, the robot cleaner may further include a sensing unit configured to sense an obstacle applied to the main body, wherein when an obstacle according to the movement of the main body is sensed, light emitting units disposed at the front portion are activated.

According to an example associated with the present disclosure may further include a plurality of detection units mounted on the main body to sense filth or dust at the outside, wherein the controller knows the driving condition of the plurality of detection units, and when an error occurs in the driving condition of the detection unit, the controller activates a light emitting unit disposed adjacent to the detection unit.

According to the present disclosure, a light emitting unit may provide light configured with a different form and color based on a driving condition of the main body, thereby allowing a user to know a driving condition of the robot cleaner using light. Furthermore, the light emitting unit may provide light to a surrounding region of the main body, thereby allowing a user to sense the surrounding condition of the robot cleaner.

Furthermore, the present disclosure may provide an aesthetic sense that seems to have a life for a robot cleaner that automatically moves without a user's control command by light with various patterns transmitted to an outside of the main body.

BRIEF DESCRIPTION OF TH DRAWINGS

The present invention will become more fully understood from the detailed description given herein below and the accompanying drawings, which are given by illustration only, and thus are not limitative of the present invention, and wherein.

DETAILED DESCRIPTION OF THE PREFERRED EMBODIMENTS

Description will now be given in detail according to the exemplary embodiments disclosed herein, with reference to the accompanying drawings. For the sake of brief description with reference to the drawings, the same or equivalent components will be provided with the same reference numbers, and description thereof will not be repeated. A suffix "module" and "unit" used for constituent elements disclosed in the following description is merely intended for easy description of the specification, and the suffix itself does not give any special meaning or function. In describing the present disclosure, if a detailed explanation for a related known function or construction is considered to unnecessarily divert the gist of the present disclosure, such explanation has been omitted but would be understood by those skilled in the art. Furthermore, the accompanying drawings are used to help easily understand the technical idea of the present disclosure and it should be understood that the idea of the present disclosure is not limited by the accompanying drawings.

Figure 2A:
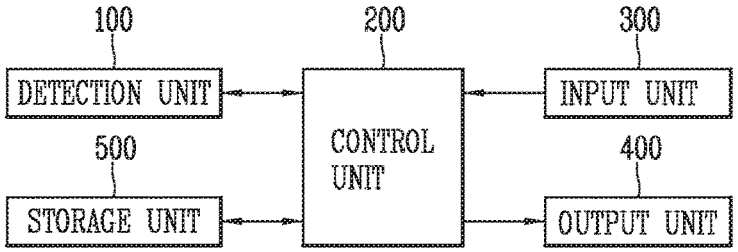
FIGS. 2A and 2B are configuration diagrams illustrating a robot cleaner according to embodiments.
Figure 2B:
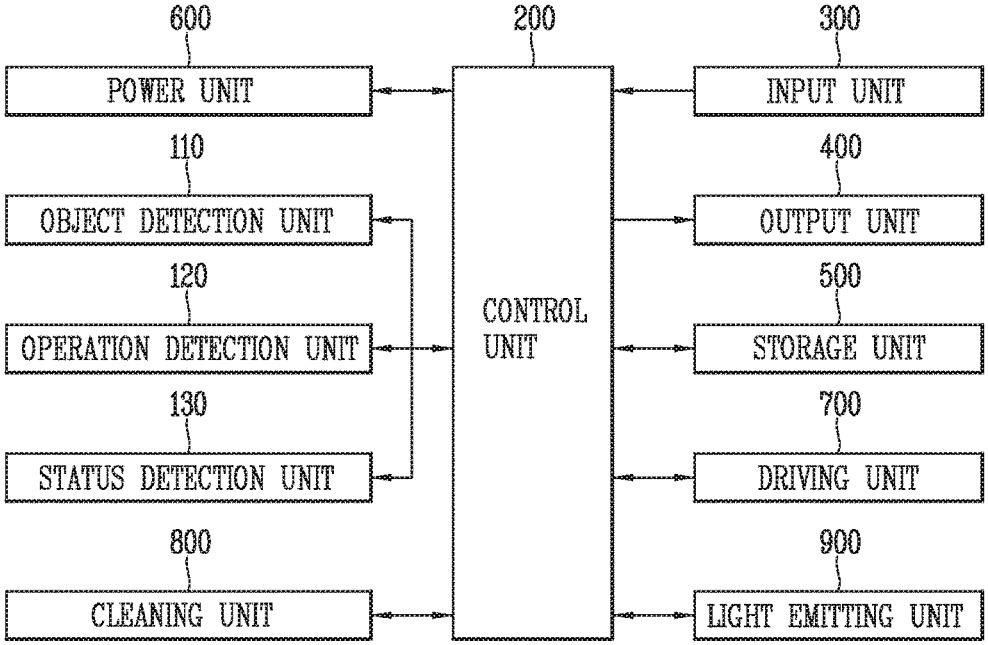

Referring to FIG. 2, a robot cleaner according to, an embodiment may include one or more detection units 100, a control unit 200, an input unit 300, an output unit 400 in a robot cleaner provided with a self diagnostic mode. One or more detection units 100 are provided in the robot cleaner to output detection information on an inside or outside thereof. The input unit 300 receives an execution command of the self diagnostic mode, and the control unit 200 executes the self diagnostic mode according to the execution command, and diagnoses the robot cleaner using the detection information. The output unit 400 outputs an execution result of the self diagnostic mode. Here, the control unit 200 diagnoses the status of the one or more detection units 100 according to the self diagnostic mode.

A user or the like directly enters a control command to the robot cleaner through the input unit 300. Furthermore, the user or the like may enter a command for outputting one or more information of the information stored in a storage unit which will be described later through the input unit. The input unit 300 may be formed with one or more buttons. For example, the input unit 300 may include an OK button and a set button. The OK button enters a command for confirming sensing information, obstacle information, location information, a cleaning region or cleaning map. The set button enters a command for setting the information. The input unit may include a reset button for entering a command of resetting the information a delete button, a cleaning start button, a stop button, and the like. For another example, the input unit 300 may include a button for setting or deleting preset information. Furthermore, the input unit 300 may further include a button for setting or changing a cleaning mode. Furthermore, the input unit 300 may further include a button for receiving a command of returning to a charging stand.

Figure 1:
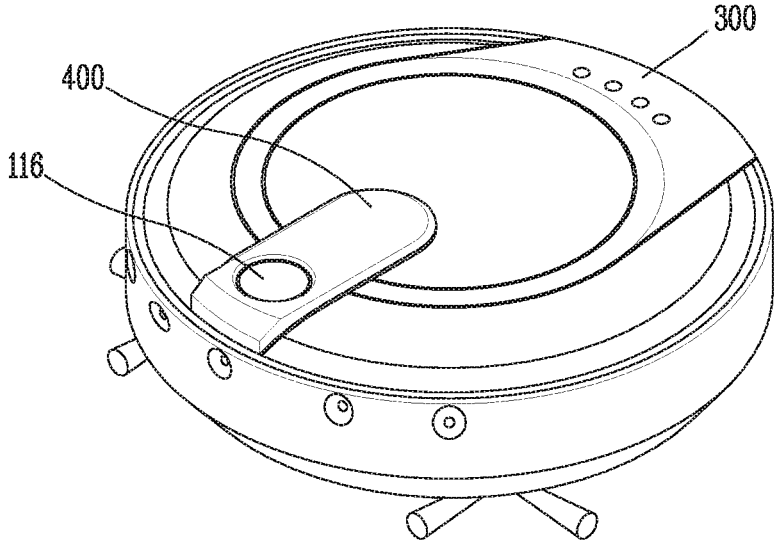
FIG. 1 is a perspective view illustrating an cuter appearance of a robot cleaner according to an embodiment.

The input unit 300, as illustrated in FIG. 1, may be provided at an upper portion of the robot cleaner with a hard key a soft key, a touchpad or the like. Furthermore, the input unit 300 may have a form of touch screen along with the output unit. The input unit 300 receives a command such as a start, an end, a stop, a release of the self diagnostic mode. The user or the like may enter a command for entering a self diagnostic mode by pressing one of buttons provided in the robot cleaner, pressing buttons in a predetermined form or pressing one button for a predetermined period of time. For another example, the user or the like may enter an execution command of the self diagnostic mode to the robot cleaner by generating a control signal using a remote control, a terminal or the like. In this case, the robot cleaner may further include a sensor or communication device for receiving a control signal. Furthermore, the input unit 300 may set or receive a diagnostic subject, a diagnostic method, a diagnostic sequence, and the like.

The output unit 400 is provided at an upper portion of the robot cleaner as illustrated in FIG. 1. Of course, an installation location or installation form thereof may vary. For example, the output unit 400 displays a cleaning method or traveling method such as preset information, battery status, intensive cleaning, space expansion, a zigzag operation, a traveling method, and the like on the screen. The output unit 400 may output status information within the robot cleaner detected by the detection unit 100, for example, a current status of each unit constituting the robot cleaner, and a current, cleaning status. Furthermore, the output unit 400 may display external, detection information detected by the detection unit 100, obstacle information, location information, a cleaning region, a cleaning map and the like on the screen. The output unit 400 may be formed with any one device of a light emitting diode (LED) a liquid crystal display (LCD), a plasma display panel, and an organic light emitting display device (OLED).

The output unit 400 may further include a sound output device for outputting an execution result of the self diagnostic mode with a sound. For example, the output unit 400 may output a beep sound to the outside according to a warning signal. The sound output device may include a device of outputting a sound such as a beeper, a speaker, or the like. The output unit 400 may output a diagnostic result to the outside using audio information stored in a storage unit which will be described later.

Referring to FIG. 2 again a robot cleaner according to an embodiment may further include a storage unit 500 in which a diagnostic algorithm according to the self diagnostic mode has been preset. The storage unit 500 may store diagnostic algorithms, respectively, according to a diagnostic subject, a diagnostic method and the like, or store a whole diagnostic algorithm in advance. The storage unit 500 may store audio information for transmitting a status of the robot cleaner and a diagnostic result to the outside. In other words, the storage unit 500 may pattern and store a status of the robot cleaner, an execution result of the self diagnostic mode and the like in the form of message data or audio data in advance. The output unit 400 is provided with a signal processing unit to signal-process audio information stored in the storage unit and output it to the outside through the sound output device.

The storage unit 500 stores a control program and the resultant data for controlling (driving) the robot cleaner. The storage unit 500 may further store image information, obstacle information, location information, a cleaning region a cleaning, map and the like in addition to audio information. Furthermore, the storage unit 500 may store a cleaning method, a traveling method. Furthermore, the storage unit 500 mostly uses a non-volatile memory. Here, the non-volatile memory (NVM, NVRAM) is a storage device for continuously maintaining stored information without supplying power. The non-volatile memory may include ROM, flash memory, magnetic computer storage device (for example, hard disk, diskette drive, magnetic tape), optical disk drive, magnetic RAM, PRAM, and the like.

Figure 3:
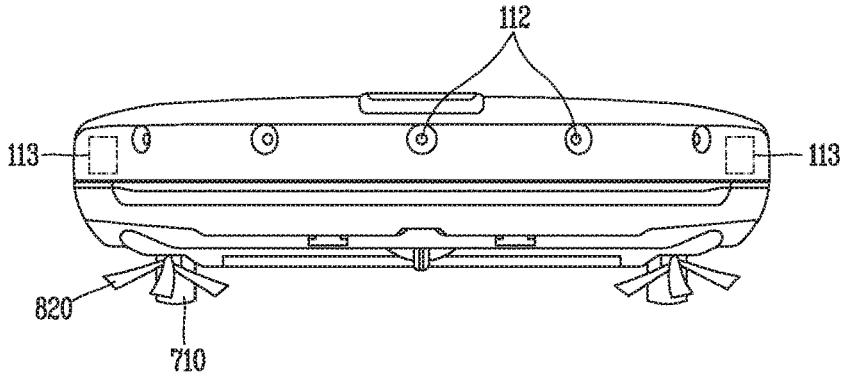
FIG. 3 is a front view illustrating a front surface of a robot cleaner according to an embodiment.

The detection unit 100 may include are object detection unit 110 for detecting an external object as illustrated in FIG. 3. Furthermore, the detection unit may further include an operation detection unit 120 for detecting the operation of the robot cleaner. Furthermore, the detection unit may further include a status detection unit 130 fore detecting the status of units constituting the robot cleaner. The detection unit may include one or more units of the detection unit 100, the operation detection unit 120 and the status detection unit 130 or a sensor constituting it.

The object detection unit 110 may include one or more sensors of an external signal sensor, a front sensor, an obstacle sensor, a cliff sensor, a lower camera sensor, and an upper camera sensor.

The robot cleaner may include an external signal sensor for sensing an external signal. The external signal sensor may be an infrared ray sensor an ultrasonic sensor, a radio frequency (RF) sensor or the like. The robot cleaner receives a guide signal generated by a charging stand using the external signal sensor to check the location and direction of the charging stand. The charging stand transmits a guide signal for directing the direction and distance thereof to allow the robot cleaner to return. The robot cleaner receives a signal transmitted from the charging stand to determine a current location, and sets a moving direction to return to the charging stand. Furthermore, the robot cleaner senses a signal generated by a remote control device such as a remote control, a terminal, or the like using the external signal sensor. The external signal sensor is provided at one side of an inside or an outside of the robot cleaner. According to the embodiments of the present disclosure, an infrared ray sensor will be described as an example for the external signal sensor. The infrared ray sensor 111 may be provided at an inside of the robot cleaner, for example, adjacent to a lower or upper camera sensor of the output unit.

When a self diagnostic mode is carried out, the control unit 200 compares an output value of the infrared ray sensor with a preset reference value, and diagnoses the infrared ray sensor using the comparison result. During the self diagnostic mode, the control unit 200 moves the robot cleaner in a predetermined pattern according to a diagnostic algorithm, and when the infrared ray sensor is unable to receive a signal from an external device such as the charging stand or the like within a predetermined distance, it is diagnosed as an infrared ray sensor error. Here, the reference value may be a predetermined number of times including zero. When there is an error on the infrared ray sensor, the output unit 400 may output a voice message such as "Charging is not attempted due to a problem of the infrared ray sensor", "Please turn of and on main power switch below the main body and then execute a diagnostic mode one more time". "Please contact a service center when problems occur repeatedly" and the like or display the message on the screen. When there is an error on the infrared ray sensor, the charging stand cannot be found, and thus the control unit 200 stops the robot cleaner at a current location, and then allows the output unit to notify the user or the like of its current status.

Figure 4:
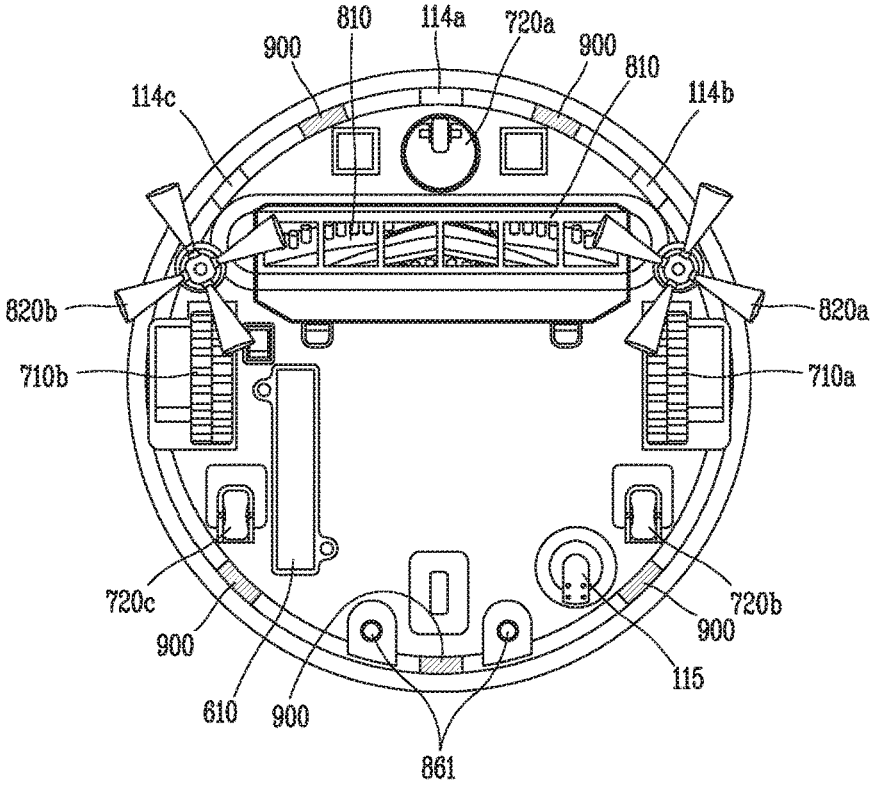
FIG. 4 is a rear view illustrating a bottom portion of a robot cleaner according to an embodiment.

The front sensors are provided at predetermined intervals at a front side of the robot cleaner, for example, on an outer circumferential surface thereof as illustrated in FIG. 4. The front sensor senses an object, particularly, an obstacle, existing in a moving direction of the robot cleaner to transfer detection information to the control unit. In other words the front sensor senses an obstacle, a household fixture, a furniture a wall surface, a wall edge, and the like to transfer the information to the control unit. The front sensor may be an infrared ray sensor, an ultrasonic sensor, a RF sensor, a geomagnetic sensor or the like. The robot cleaner may use a type of sensor or use two types of sensors at the same time for the front sensor when needed. According to the embodiments of the present disclosure, the front sensor will be described as an ultrasonic sensor, for example.

Figure 6:
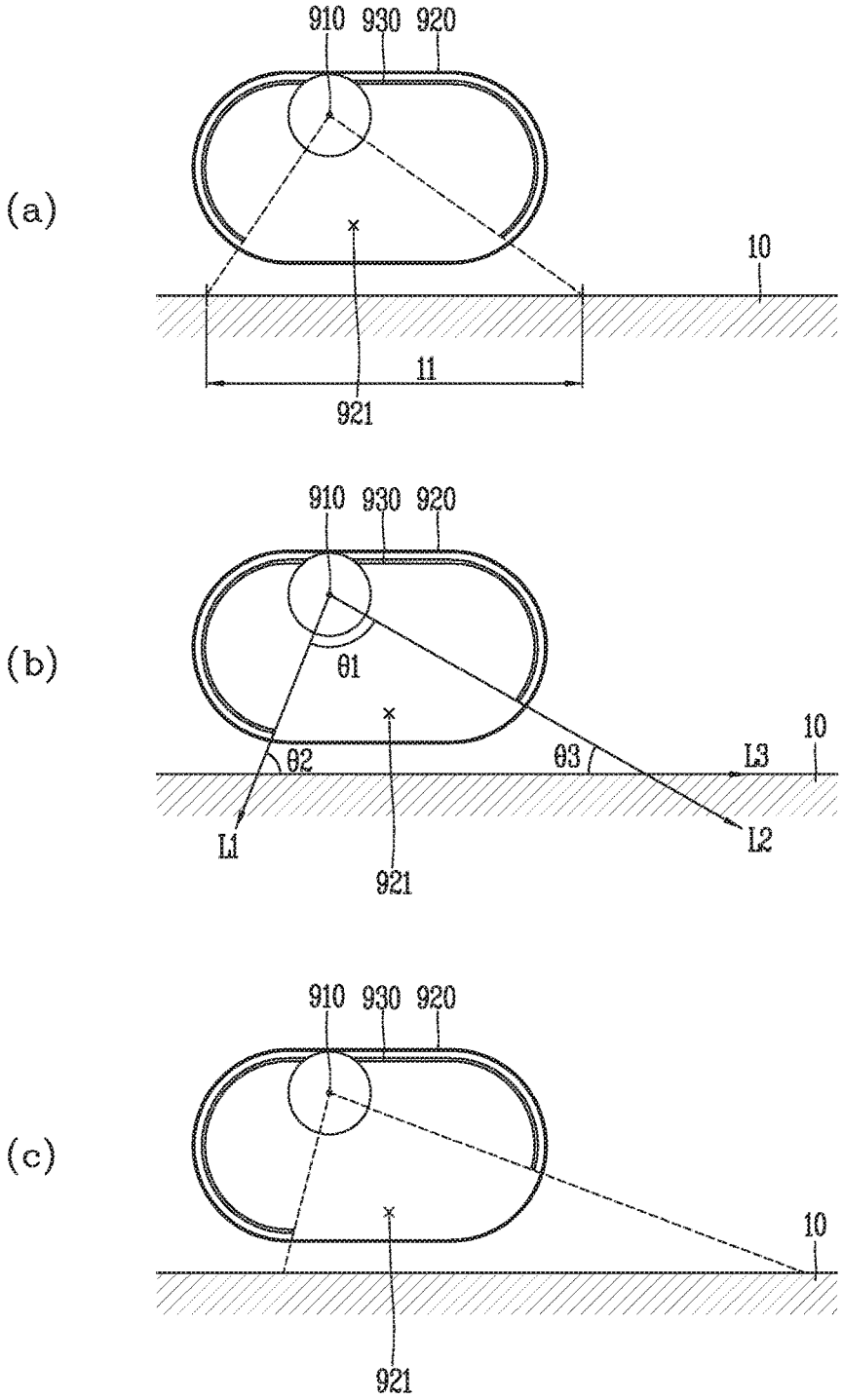
FIG. 6 is a conceptual view for explaining a driving method of a light emitting unit according to an embodiment.

Typically, the ultrasonic sensor is mostly used to sense a remote obstacle. The ultrasonic sensor may include a transmitter and a receiver. The control unit 200 determines the existence or non-existence of an obstacle based on whether or not ultrasonic waves transmitted through the transmitter are reflected by an obstacle or the like and received at the receiver, and calculates a distance to the obstacle using a received time. Referring to FIG. 4 or 6, five ultrasonic sensors 112 are provided along an outer circumferential surface of a front side of the robot cleaner. Referring to FIG. 6, the robot cleaner is alternately provided with the transmitters 112*a* and receivers 112*b* of the ultrasonic sensor. In other words, ultrasonic sensors for transmission and ultrasonic sensors for reception are alternately provided on a front surface of the registered by. Referring to FIG. 4 or 6 the transmitters 112*a* are disposed at the left and right sides to be separated from a frontal center of the main body. One or two or more transmitters 112*a* are disposed between the receivers 112*b* to form a reception region of a signal reflected from the obstacle or the like. With such an arrangement, it may be possible to expand a reception region while reducing a number of sensors. The transmission angle of ultrasonic waves maintains an angle in a range of not exerting an effect on different signals to prevent a crosstalk phenomenon. The reception sensitivities of the receivers 112*b* may be differently set. Furthermore, a ultrasonic sensor may be installed in an upward direction by a predetermined angle to output ultrasonic waves transmitted from the ultrasonic sensor in an upward direction. Furthermore, the ultrasonic sensor may further include a barrier member to prevent ultrasonic waves from being radiated in a downward direction.

The ultrasonic sensor transfers a different output value to the control unit according to the existence or non-existence of an obstacle, a distance to the obstacle. A range of the output value may be set to vary according to a sensing range of the ultrasonic sensor. When a self diagnostic mode is carried out, the control unit 200 compares an output value of the ultrasonic sensor with a preset reference value, and diagnoses the ultrasonic sensor using the comparison result. During the self diagnostic mode, since there does not exist another object other than the charging stand around the robot cleaner, it should be sensed that there is no obstacle. The control unit 200 moves the robot cleaner in a predetermined pattern according to a diagnostic algorithm, and diagnoses it as an ultrasonic sensor error when the ultrasonic sensor outputs an output value above a reference value like a case there exists an obstacle. For example, the control unit 200 may diagnose an error of the ultrasonic sensor using an output value in a state that the robot cleaner makes a predetermined distance to the charging stand, an output value subsequent to the rotation of 180 degrees, an output value subsequent to moving a predetermined distance in a linear manner, and the like. When there is an error on the ultrasonic sensor, the output unit 400 may output a voice message such as "Charging is not attempted due to a problem of the ultrasonic sensor", "Please turn off and on main power switch below the main body and then execute a diagnostic mode one more time", "Please contact a service center when problems occur repeatedly", and the like or display the message on the screen. When there is an error on the ultrasonic sensor, the robot cleaner is unable to sense the charging stand that might be located in the front, and there is a worry of collision with the charging stand. Accordingly, the control unit 200 stops the robot cleaner at a current location without moving the robot cleaner to the charging stand, and then allows the output unit to notify the user or the like of its current status.

An obstacle sensor 113 is provided on an outer circumferential surface of the robot cleaner along with the front sensor as illustrated in FIG. 4 or 6. Furthermore, the obstacle sensor is not provided along an outer circumferential surface thereof, but formed to have a surface protruded to an outer side of the robot cleaner main body. The obstacle sensor may be an infrared ray sensor, an ultrasonic sensor, a RF sensor, a position sensitive device (PSD), or the like, and senses an obstacle existing in the front or side to transfer the obstacle information to the control unit. In other words, the obstacle sensor senses an obstacle existing on a moving path of the robot cleaner, household fixture, a furniture, a wall surface a wall edge, and the like to transfer the information to the control unit. The robot cleaner may move while maintaining a distance to the wall surface using the front sensor or obstacle sensor. According to the embodiments of the present disclosure, the front sensor will be described as a PSD sensor, for example.

The PSD sensor detects a short/long distance location of incident light with one p-n junction using a semiconductor surface resistance. The PSD sensor may include a one-dimensional PSD sensor for detecting light only in one axial direction and a two-dimensional PSD sensor for detecting light location on a plane, and both have a pin photo diode structure. As a type of infrared ray sensor, the PSD sensor emits, infrared rays on an obstacle to sense the obstacle, and measures a distance using a reflection and return time. In other words, the PSD sensor may include a light transmitter for emitting infrared rays to an obstacle and a light receiver for receiving infrared rays reflected and returned from the obstacle, and typically configured in a modular form. The PSD sensor obtains a stable measurement value regardless of color difference, and uses a triangulation method.

The PSD sensor transfers a different output value to the control unit according to the existence or non-existence of an obstacle, and a distance to the obstacle similarly to the ultrasonic sensor. A range of the output value may be set to vary according to a sensing range of the PSD sensor. When a self diagnostic mode is carried out, the control unit 200 compares an output value of the PSD sensor with a preset reference value, and diagnoses the PSD sensor using the comparison result. During the self diagnostic mode, since there does not exist another object other than the charging stand, it should be sensed that there is no obstacle. The control unit 200 moves the robot cleaner in a predetermined pattern according to a diagnostic algorithm, and diagnoses it as a PSD sensor error when the PSD sensor outputs an output value above a reference value. For example, the control unit 200 may allow the robot cleaner to move a predetermined distance in an opposite direction to the charging stand in a linear manner, and compares an output value and a reference value to diagnose an error of the PSD sensor. The output unit 400 may output a voice message such as "Please wash obstacle sensor windows on the left and right" and the like or display the message on the screen.

Figure 5:
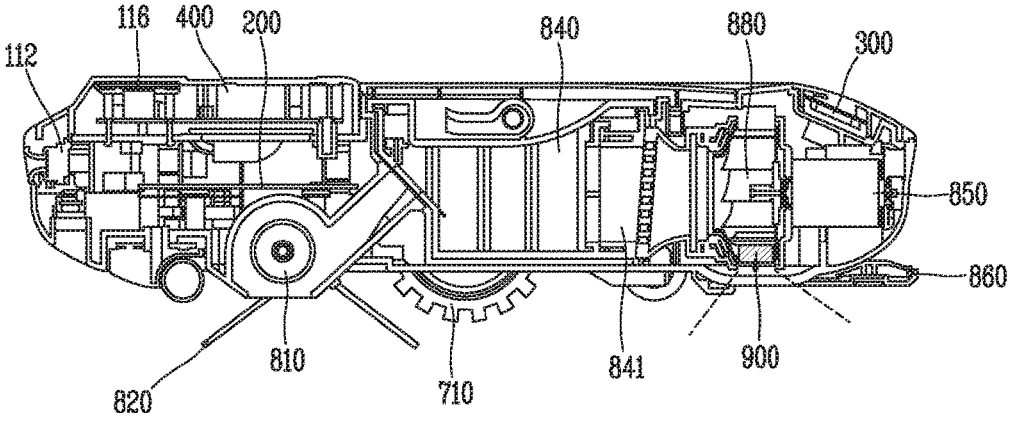
FIG. 5 is a side cross-sectional view illustrating a bottom portion of a robot cleaner according to an embodiment.

A precipice sensor is also referred to as a cliff sensor in another word. The cliff sensor mostly uses various types of light sensors, and according to the present embodiment, it will be described as an infrared ray sensor, for example. In this case, the cliff sensor may have a form of the infrared ray sensor having a light transmitter and a light receiver similarly to the obstacle sensor. Referring to FIG. 5, the cliff sensor 114 is provided within a groove having a predetermined depth existing on a lower surface of the robot cleaner. The cliff sensor may be provided at a different location according to, the type of the robot cleaner.

Referring to FIG. 5, one cliff sensor is provided at a front side of the robot cleaner, and two sensors are provided relatively at a rear side thereof. The configuration of FIG. 5 may be used as follows, for example. For the sake of convenience of explanation the cliff sensor provided at the most front side is referred to a first sensor 114*a*, and the sensor provided at the rear side is referred to as second sensor 114*b*, 114*c*. The first sensor and the second sensor may be typically configured with the same type of sensors, for example, infrared ray sensors, or configured with different types of sensors. The control unit 200 may sense a cliff and analyze the depth by allowing the first sensor to emit infrared rays toward the ground and using a received time of a reflected signal received therefrom. Furthermore, the control unit 200 may know the ground status of a cliff sensed by the first sensor using the second sensor. For example, the control unit 200 may determine the existence or non-existence of a cliff and the depth of the cliff through the first sensor, and then allow the robot cleaner to pass therethrough only when a reflected signal has been sensed through the second sensor. For another example, the control unit 200 may determine a lifting phenomenon of the robot cleaner with a combination of the sensing results of the first and the second sensor.

The cliff sensor continuously senses the ground while the robot cleaner moves. When, a self diagnostic mode is carried out, the control unit 200 compares an output value of the cliff sensor with a preset reference value, and diagnoses the cliff sensor using the comparison result. During the self diagnostic mode, the control unit 200 moves the robot cleaner in a predetermined pattern according to a diagnostic algorithm, and when the cliff sensor outputs an output value above the reference value, the control unit 200 determines it as an error. For example, the control unit 200 moves the robot cleaner straight by a predetermined distance, and then when the output value of the cliff sensor is above a reference value, the control unit 200 determines it as an error. When there is an error on the cliff sensor, the output unit 400 may output a voice message such as "There is an error on the cliff sensor at the front, ground", "Charging is not attempted due to a problem of the cliff sensor, "Please clean the sensor", and the like or display the message on the screen. When there is an error on the cliff sensor, the robot cleaner is unable to sense a cliff that might be located in the front, and there is a worry of damage itself. Accordingly, the control unit 200 stops the robot cleaner at a current location without moving the robot cleaner to the charging stand, and then allows the output unit to notify the user or the like of its current status.

A lower camera sensor 115 is provided on a rear side of the robot cleaner to capture a lower side, namely, a floor surface, a cleaned surface during the movement as illustrated in FIG. 5. The lower camera sensor is referred to as an optical flow sensor in other words. The lower camera sensor converts a lower side image received from an image sensor provided within the sensor to generate predetermined type of image data. The generated image data is stored in the storage unit 500. The lower camera sensor may further include a lens and a lens control unit for controlling the lens. A pan-focus lens having a short focal length and a large depth may be preferably used for the lens. The lens control unit is provided with a certain motor for moving back and forth and a moving device to control the lens. Furthermore, one or more light sources may be provided adjacent to the image sensor. The one or more light sources irradiate light to a region of the floor surface captured by the image sensor. In other words, when the robot cleaner moves over a cleaning region along the floor surface, a predetermined distance is maintained between the image sensor and the floor surface if the floor surface is flat. On, the contrary, when the robot cleaner moves over a non-uniform floor surface. It is more than a predetermined distance away therefrom due to a convex-concave floor surface and obstacles. Here, the one or more light sources may be formed to control an amount of irradiated light. The light source is formed with a light emitting element capable of controlling an amount of light for example, light emitting diode (LED).

The lower camera sensor may detect a location of the robot cleaner regardless of the sliding of the robot cleaner. The control unit 200 compares and analyzes image data captured by the lower camera sensor according to the flow of time to calculate a moving distance and a moving direction thereof, and calculates a location of the robot cleaner as a result. A lower side of the robot cleaner may be viewed using, the lower camera sensor, thereby allowing the control unit to make a robust correction on the sliding with respect to a location calculated by another means.

The lower camera sensor always captures the floor surface during the movement, thereby outputting a value above a predetermined value. When a self diagnostic mode is carried out, the control unit 200 diagnoses the lower camera sensor based on whether or not the output value of the lower camera sensor is above a preset reference value (for example, any value including zero). The control unit 200 moves the robot cleaner straight by a predetermined distance in an opposite direction to the charging stand according to a diagnostic algorithm, and when the lower camera sensor outputs a value below a reference value or outputs a value out of a range, the control unit 200 diagnoses it as a lower camera sensor error. When there is an error on the lower camera sensor, the output unit 400 may display a voice message such as "Please clean the lower camera sensor window at the right bottom" and the like or display the message on the screen.

Referring to FIG. 1 the robot cleaner may further include an upper camera sensor 116 provided to face the upward or forward direction to capture the surroundings of the robot cleaner. When the robot cleaner is provided with a plurality of upper camera sensors, the camera sensors may be formed at an upper portion or on a lateral surface of the robot cleaner at a predetermined distance or predetermined angle. The robot cleaner may further include a lens connected to an upper camera sensor to focus on a subject, a control unit configured to control the camera sensor, and a lens control unit configured to control the lens. The lens uses a lens with a wide field of vi to capture the entire surrounding region even at a predetermined position, for example, the entire region of a ceiling. For example, the lens includes a lens with a field of view above a predetermined angle, for example, 160 degrees. The control unit 200 may receive a signal or data from the upper camera sensor to diagnose the status. In other words, the control unit 200 may diagnose the status of the upper camera sensor using whether or not the upper camera sensor has captured or image data captured by the upper camera sensor.

The control unit 200 may recognize a location of the robot cleaner using image data captured by the upper camera sensor, and prepare a cleaning map for a cleaning region. The control unit 200 may precisely recognize the location using an acceleration sensor, a gyro sensor, a wheel sensor, the detection information of the lower camera sensor, and the image data of the upper camera sensor. Furthermore, the control unit 200 may precisely generate a cleaning map using obstacle information detected by the front sensor, obstacle sensor or the like and a location recognized by the upper camera sensor.

The operation detection unit 120 may include at least one of an acceleration sensor, a gyro sensor and a wheel sensor to detect the operation of the robot cleaner.

The acceleration sensor senses a speed change of the robot cleaner, for example, a change of its moving speed according to a start, a stop, a directional change, a collision with an object, and the like. The acceleration sensor may be attached to a position adjacent to main wheels or auxiliary wheels to detect the sliding or idling of the wheels. Here, the control unit 200 may calculate a speed using an acceleration detected through the acceleration sensor, and check or correct a location of the robot cleaner through comparing with an instruction speed. However, according to the embodiments, of the present disclosure, the acceleration sensor is integrated into the control unit 200 to sense a speed change in the robot cleaner itself generated in a cleaning mode, a traveling mode. In other words, the acceleration sensor detects an amount of impact according to the speed change to output a voltage value corresponding to the amount of impact. Accordingly, the acceleration sensor may perform a function of an electronic bumper.

The acceleration sensor continuously senses the ground while the robot cleaner moves. When a self diagnostic mode is carried out, the control unit 200 compares an output value of the acceleration sensor with a preset reference value, and diagnoses the acceleration sensor using the comparison result. During the self diagnostic mode, the control unit 200 moves the robot cleaner in a predetermined pattern according to a diagnostic algorithm, and when the acceleration sensor outputs an output value above the reference value, the control unit 200 determines it as an acceleration sensor error. When there is an error on the acceleration sensor, the output unit 400 may output a voice message such as "An error has been found on the acceleration sensor", "Please turn off and on main power switch below the main body and then execute a diagnostic mode one more time", "Please contact a service center when problems occur repeatedly" and the like or display the message on the screen.

The gyro sensor senses a rotation direction when the robot cleaner moves according to an operation mode to detect a rotation angle. The gyro sensor detects an angular speed of the robot cleaner to output a voltage value in proportion to the angular speed. The control unit 200 calculates a rotation direction and a rotation angle using a voltage value outputted from the gyro sensor.

The robot cleaner may further include a wheel sensor connected to main wheels at the left and right sides to sense a rotation number of the main wheels. The wheel sensor may be a rotary encoder. The rotary encoder senses and outputs a rotation number of the main wheels at the left and right sides when the robot cleaner moves according to a traveling mode or cleaning mode. The control unit may calculate a rotation speed of the left and the right wheel using a rotation number. During a self diagnostic mode, the control unit 200 moves the robot cleaner in a predetermined pattern according to a diagnostic algorithm, and then compares a speed calculated using an output value of the wheel sensor with an instruction speed. The control unit diagnoses an error of the main wheel using the comparison result. Furthermore, the control unit may diagnose an error using a difference in the rotation numbers or rotation speeds of the left and right wheels. When there is an error on the main wheel the output unit 400 may output a voice message such as "Please check foreign substances on the left wheel", "Please check foreign substances on the right wheel" and the like or lay the message on the screen.

The control unit 200 may calculate a rotation angle using a difference the rotation numbers of the left and right wheels. Furthermore, the control unit, compares a rotation angle calculated using an output value of the wheel sensor with an output rotation angle of the gyro sensor, and diagnoses the gyro sensor using the comparison result. During a self diagnostic mode, the control unit rotates the robot cleaner by 180 degrees in the left and right directions around the charging stand or reference position according to a diagnostic algorithm. Then, the control unit calculates or detects rotation angles through the wheel sensor or gyro sensor to compare with each other. For example, when a difference in the rotation angles is above a predetermined angle, for example, 30 degrees, the control unit diagnoses it as a gyro sensor error. When there is an error on the gyro sensor, the output unit 400 may output a voice message such as "An error has been found on the gyro sensor", "Please turn off and on main power switch below the main body and then execute a diagnostic mode one more time", "Please contact a service center when problems occur repeatedly", and the like or display the message on the screen.

The status detection unit 130 may include sensors for detecting a main wheel status, a wheel drop switch status, a suction motor status, an agitator status, and the like, as sensors for detecting the status of each unit. Furthermore, the status detection unit may include sensors for detecting a dust container status, a battery status, a mop plate, and the like. The control unit 200 checks one or more execution conditions prior to the execution of the self diagnostic mode. The execution condition of the self diagnostic mode is one of a mounting state of the dust container, an attachment state of the mop plate, and a battery status or a combination of the states. Furthermore, the control unit 200 checks a current operation mode, and checks whether or not a preset cleaning has been set, and then executes a self diagnostic mode.

The robot cleaner is provided with a left and a right main wheel 710*a*, 710*b* at both lower sides thereof to move the robot cleaner as illustrated in FIGS. 4 through 7. A handle may be provided at both lateral surfaces of the main wheel to facilitate a user's grip. Referring to FIG. 3, the robot cleaner may further include a driving unit 700. The driving unit 700 are connected to the left and the right main wheel. The driving unit is provided with a predetermined number of wheel motors for rotating the wheels to drive the wheel motors, thereby moving the robot cleaner. The wheel motors are connected to the main wheels, respectively, to rotate the main wheels and the wheel motors operate in an independent manner from each other to allow rotation in both directions. Furthermore, the robot cleaner is provided one or more auxiliary wheels 720*a*, 720*b* on a rear surface thereof to support the robot cleaner, minimize a friction between the robot cleaner and the floor surface (cleaned surface), and facilitate the movement of the robot cleaner.

When a command for executing a self diagnostic mode is received, the control unit 200 diagnoses the status of the wheel motor. The control unit 200 is provided with a current detection device to detect a driving current of the wheel motor. Then, the control unit 200 compares the detected driving current with a preset reference current to diagnose the status of the wheel motor according to the comparison result. The current detection device may not only use a current transducer or the like, but also simply use a shunt resistance. When there is an error on the main wheel, the output unit 400 may output a voice message such as "Please check foreign substances on the left wheel". "Please check foreign substances on the right wheel" and the like or display the message on the screen.

The robot cleaner may further include a wheel drop switch that is operated when lifted up by a user or obstacle, namely, when the main wheel is lifted up from the floor surface to notify it. The wheel drop switch is typically a contact type mechanical switch. When a command for executing a self diagnostic mode is received, the control unit 200 checks the status of the wheel drop switch. The wheel drop switch should be always off during a normal travel, and therefore, the control unit 200 executes, the self diagnostic mode, and then checks whether or not the wheel drop switch is off. When the wheel drop switch is on the output unit 400 may output a voice message such as "An error has been found on the left (right) wheel drop switch", "Please turn off and on main power switch below the main body and then attempt smart diagnostics again", "Please contact a service center when problems occur repeatedly", and the like or display the message on the screen. The storage unit 500 may store the message in advance.

Referring to FIG. 3, the robot cleaner may further include a cleaning unit 800. Referring to FIGS. 4 through 7, the cleaning unit 800 is configured with a dust container 840 configured to store collected dust, a suction fan 880 configured to provide power for suctioning dust in a cleaning region, and a suction motor 850 configured to rotate the suction fan to suction air, thereby suctioning dust or foreign substances in the vicinity. The suction fan 880 may include a plurality of vanes for flowing air, and a member formed in a ring shape at outer edge of an upstream side of the plurality of vanes and connected to the plurality of vanes to guide the air introduced in a direction of the central axis of the suction fan to flow in a direction perpendicular to the central axis.

When a command for executing a self diagnostic mode is received, the control unit 200 diagnoses the status of the suction motor 850. The control unit 200 is provided with a current detection device to detect a driving current of the suction motor 850. Then, the control unit 200 compares the detected driving current with a preset reference current to diagnose the status of the suction motor 850 according to the comparison result. The current detection device may not only use a current transducer or the like, but also simply use a shunt resistance. When there is an error on the suction motor, the output unit 400 may output a voice message such as "An error has been found on the suction motor", "Please activate main power switch again below the main body and then attempt smart diagnostics again", "Please contact a service center when problems occur repeatedly", and the like or display the message on the screen.

The cleaning unit 800 may further include an agitator 810 rotatably mounted at a lower portion of the robot cleaner main body, and a side brush 820 configured to clean an edge or corner of the cleaning region such as a wall surface while rotating around a rotating shaft of the main body in a vertical direction. The agitator 810 floats dust on the ground or carpet in the air while rotating around a horizontal axis of the robot cleaner main body. A plurality of blades are provided in a spiral direction on an outer circumferential surface of the agitator 810. A brush may be provided between spiral blades. The rotating axes of the agitator 810 and side brush 820 are different from each other, and thus the robot cleaner should be provided with motors for driving the agitator and side brush, respectively. For another example, as illustrated in FIGS. 4 and 5, the robot cleaner may be provided with a transmission means 891 for transmitting a rotational force of the agitator to the side brush between the agitator and the side brush to drive both the agitator and side brush using one brush motor. In the latter case, a worm and a worm gear may be used or a belt may be used for the transmission means.

When a command for executing a self diagnostic mode is received the control unit 200 diagnoses the status of a brush motor 890. The control unit 200 rotates the agitator 810, and detect a rotation speed of the agitator. Then, the control unit 200 compares the detected rotation speed with a preset reference speed to diagnose an error of the agitator. The reference speed may be set to 500 rpm, for example. When there is an error on the agitator, the output unit 400 may output a voice message such as "Please check whether foreign substances are inserted into the agitator" and the like or display the message on the screen.

Figure 7:
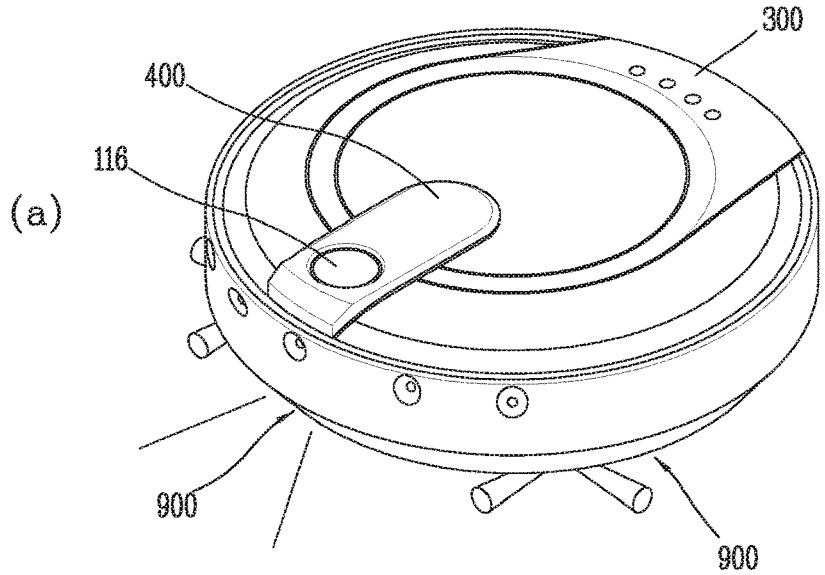
FIG. 7 is a conceptual view for explaining a method of activating a plurality of light emitting units according to an embodiment.
Figure 7:
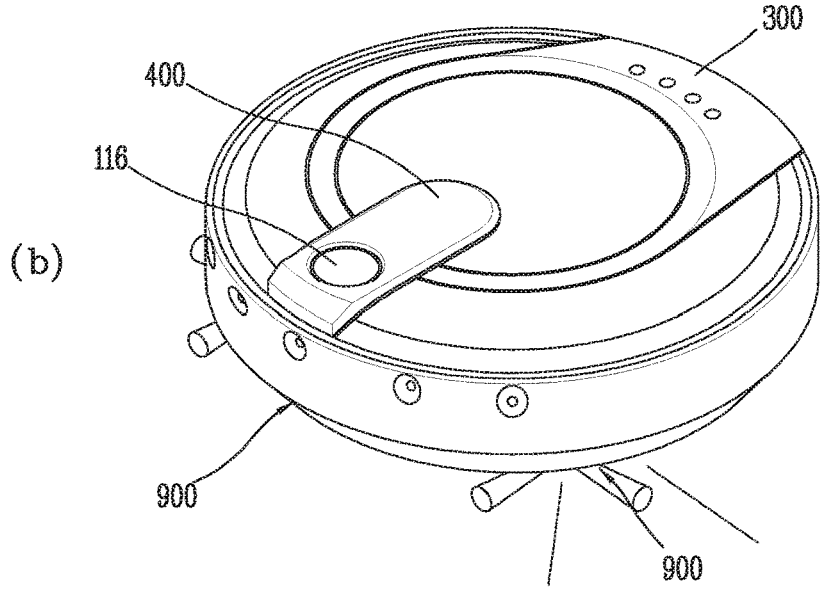

The cleaning unit 800 referring to FIGS. 6 and 7, further includes a dust container 840 configured to collect dust and a portion into which the dust container is accommodated. The cleaning unit 800 may further include a filter 841 for filtering out filth or dust in the air. The filter 841 may be configured with a first filter and a second filter in a divided manner if necessary, and a bypass filter may be formed on a body forming the filter. The first and the second filter may be mesh filters or HEPA filters, and formed with one of a nonwoven fabric, a paper filter or used with two or more of them in combination.

The status of the dust container largely denotes a state in which a certain amount of dust or the like is contained in the dust container and a state in which the dust container is attached to or detached from the robot cleaner. In the former case, a piezoelectric sensor may be inserted into the dust container to sense it. In the latter case, the mounting status of the dust container may be sensed in various ways. For example, for a sensor for sensing whether or not the dust container is mounted thereon, a micro switch provided on a lower surface of a groove into which the dust contained is mounted to be turned on or off, a magnetic sensor using a magnetic field of a magnet, a magnetic field sensor using a magnetic field of a magnetic body, a light sensor provided with a light transmitter and a light receiver to receive light, or the like may be used. In case of a magnetic sensor or magnetic field sensor, it may further include a sealing member with a synthetic rubber material on a portion to which a magnet or magnetic body is attached.

When a command for executing a self diagnostic mode is received, the control unit 200 first checks whether or not the dust container is mounted within the robot cleaner as a precondition of the execution. When the dust container is mounted on the robot cleaner, the output unit 400 may output a voice message such as "Please check the dust container", and the like or display the message on the screen. The storage unit 500 may store the message in advance. Of course, the control unit 200 first checks whether or not the dust container is mounted thereon even in another operation mode, cleaning or traveling mode.

Referring to FIG. 3, the robot cleaner further includes a power unit 600. The power unit 600 is provided with a rechargeable battery 610 to supply power into the robot cleaner. The power unit 600 supplies driving power to each unit as the robot cleaner moves or performs cleaning, and when the remaining power is insufficient, the robot cleaner moves to the charging stand to be charged by receiving a charging current. The battery is connected to a battery sensing unit to transfer the remaining amount and charging status of the batter to the control unit. The output unit 400 may be located at a central lower portion of the robot cleaner or located at either one of the left and right sides to allow the dust container be located at the towel lost end of the main body as illustrated in FIG. 5. In the latter case, the robot cleaner may further include a balance weight to resolve weight bias in the battery.

When a command for executing a self diagnostic mode is received, the control unit 200 first checks the remaining amount and status of the battery as a precondition of the execution. The output unit 400 may output a voice message such as "The remaining amount of the battery is insufficient", "Unable to enter diagnostic mode due to insufficient battery, and the like or display the message on the screen. The storage unit 500 may store the message in advance.

Referring to FIG. 7, the cleaning unit 800 further includes mop plates 860, 861 mounted at a lower portion of the robot cleaner main body in a separable manner. The mop plate may include a mop mounted in, a separable manner, and a user may separate only a mop to clean or replace it. The mop may be mounted thereon in various ways, but may be also attached to a mop plate using a nonwoven fabric such as Velcro. For example, the mop plate is mounted on the robot cleaner main body by a magnetic force. A first magnet may be provided at the mop plate, and a metal member corresponding to the first magnet or a second magnet may be provided at the robot cleaner main body. When the mop plate is normally placed at the bottom of the robot cleaner main body, the mop plate is fixed to the robot cleaner main body by the first magnet and the metal member or the first magnet and the second magnet. The robot cleaner further includes a sensor for sensing whether or not the mop plate is mounted thereon. For example, the sensor may be a reed switch operated by a magnetic force, a Hall sensor, or the like. For example, the reed switch is provided in the robot cleaner main body, and operated as the mop plate is coupled to the robot cleaner main body to output a mounting signal to the control unit.

When a command for executing a self diagnostic mod is received, the control unit determines whether or not the mop plate is attached thereto using a mounting signal. When the mop plate is attached thereto, the output values of the sensors may vary, thereby detaching the mop plate and then executing a diagnostic mode. When the mop plate is attached to the robot cleaner, the output unit 400 may output a voice message such as "Unable to enter diagnostic mode since the mop plate is attached thereto", "Please remove the mop plate to retry", and the like or display the message on the screen. The storage unit 500 may store the message in advance. Of course, the control unit 200 first checks whether or not the mop plate is attached thereto even in another operation mode, cleaning or traveling mode.

Referring to FIGS. 1 through 6 together, a robot cleaner having a plurality of operation modes according to another embodiment may include a storage unit 500 configured to store an algorithm for the plurality of operation modes, a control unit 200 configured to execute the plurality of operation modes using the algorithm, an input unit 300 configured to receive an execution command for an operation mode to be executed by the control unit 200, and an output unit 400 configured to output a result of the operation mode executed by the control unit 200. Here, the plurality of operation modes may include at least a self diagnostic mode. The plurality of operation modes may include a cleaning mode, a traveling mode, and the like in addition to the charging mode and the self diagnostic mode.

Referring to FIGS. 2 and 4, a robot cleaner according to the present disclosure includes a light emitting unit 900. The control unit 200 controls the light emitting unit 900 to emit light toward an outside of the main body according to a driving condition of the driving unit 700. Referring to FIGS. 4 and 5, the light emitting unit 900 is disposed at a lower portion of the robot cleaner main body, and formed to emit light toward the ground supporting the main body.

The control unit 200 controls the light emitting unit 900 to emit light in different forms based on a first driving, condition in which the main body stops a second driving condition in which the main body moves, and a third driving condition in which the main, body rotates. The light emitting unit 900 is configured with a plurality of light emitting units disposed to be separated from one another. The control unit 200 may be controlled to activate at least one of the plurality of light emitting units or allow the plurality of light emitting units to emit light in different forms, respectively.

The light emitting unit 900 may be disposed at preset intervals based on an outer circumferential surface of the main body. On the drawing, it is illustrated that five light emitting units 900 are formed at a lower portion of the main body, but the present disclosure may not be necessarily limited to this. Here, the detailed structure of the light emitting unit 900 mounted on a lower portion of the body.

FIG. 6 is a conceptual view for explaining the structure of the light emitting unit 900. Referring to FIG. 6, the light emitting unit 900 may include a light emitting portion 910 formed to emit at least one color light, a support portion 920 formed of a transparent material to transmit the light to an outside of the main body, and configured to fix the light emitting portion to a preset region, and a reflector 930 formed in one region of the support portion 920 to reflect the light.

As illustrated in the drawing, the light emitting unit 900 is mounted on the main body to emit light toward the ground 10. Accordingly, a user may check light formed to surround part of the outer circumferential surface of the main body.

The support portion 920 may be formed with two planes facing each other and two curved surfaces connecting, both ends of the two planes. A light emitting portion 910 for emitting light is mounted in one region on an inner surface of the support portion 920. The light emitting portion 910 may be preferably formed on one plane facing the ground 10, but the present disclosure may not be necessarily limited to this.

Here, the light emitting portion may be preferably formed with a light emitting diode (LED).

The reflector 930 is formed on part of an inner surface of the support portion 920. One region of the support portion 920 exposed by the reflector 930 may be defined as a transmissive region 921. In other words, the reflector 930 reflects light transmitted to an inside of the support portion 920 by the light emitting portion 910 toward the transmissive region 921. The reflector 930 may be mounted on the support portion 920 in the form of a reflective sheet.

Light emitted from the light emitting portion 910 is reflected by the reflector 930 and then emitted to the ground 10 through the transmissive region 921 of the support portion 920 made of the transparent material. One region of the ground 10 in which the light reaches by the transmissive region 921 formed by the reflector 930 is defined as a light emitting region 11. According to the present disclosure, the containment building 11 is formed to surround part of an outer circumference of the main body. In other words, the reflector 930 is formed to allow the light to reach an outside of the outer circumference from a lower portion of the main body.

According to an embodiment of the present disclosure, the reflector 930 is mounted in a movable manner at an inside of the support portion 920. In other words, the control unit 200 may include a motor controller 203 (refer to FIG. 8A) for moving the reflector 930 according to the driving condition. In other words, the motor controller 203 controls the movement of the reflector 930 to change the light emitting region 11 according to the driving condition.

The reflector 930 mounted on an inner surface of the support portion 920 moves along an inner surface of the support portion 920 to move the location of the transmissive region 921 of the support portion 920. In other words, an area of the transmissive region 921 is substantially the same even when the reflector 930 moves. However, as the transmissive region 921 moves, the light emitting region 11 of the ground 10 is changed. For example, when comparing FIGS. 6A and 6C, an area of the light emitting region 11 substantially increases as the transmissive region 921 gets closer to an outer circumferential surface of the main body.

Specifically, a first angle (θ1) between a first and a second line (L1, L2) connecting both ends of the reflector 930 from the light emitting portion 910 is formed to be less than about 90 degrees. Furthermore, a second angle (θ2) between a third line (L3) constituting the ground and formed toward the outside from the main body and the first line (L1) is formed to be larger than 90 degrees. Furthermore, a third angle (θ3) formed by the second line (L2) and the third line (L3) is formed to make a preset angle by the movement of the reflector 930. As the third angle (θ3) decreases, the light emitting region 11 with a larger area based on the outer circumference is formed.

Part of light emitted from the ground 10 reaches an outside of the main body by a limited range of the first and the second angle (θ2, θ3). Accordingly, a user may receive light in a shape of surrounding an outer circumference of the robot cleaner.

Referring to FIGS. 6A through 8C, the motor controller 203 moves the reflector 930 according to the driving condition, and changes the third angle (θ3) by the movement of the reflector 930. The light emitting region 11 of the ground that transmits light is varied by a change of the third angle (θ3). The motor controller 203 may move the transmissive region 921 in a direction closer to an outer circumference of the main body to control the light to reach up to a more distant region.

FIG. 7 is a conceptual view for explaining a light emitting unit capable of emitting light in a plurality of various methods. The light emitting unit 900 is formed with a plurality of light emitting devices, and disposed along an outer circumference of the main body. Furthermore, each of the plurality of light emitting devices may be independently activated by the control unit 200. In other words, as illustrated in the drawing, the control unit 200 may control only one of the plurality of light emitting devices mounted in different regions of the main body to emit light, and deactivate the one light emitting device and consecutively activate other light emitting devices.

Accordingly, a light emitting unit of the robot cleaner according to an embodiment of the present disclosure may emit light in various forms or emit light to form a pattern.

Figure 8A:
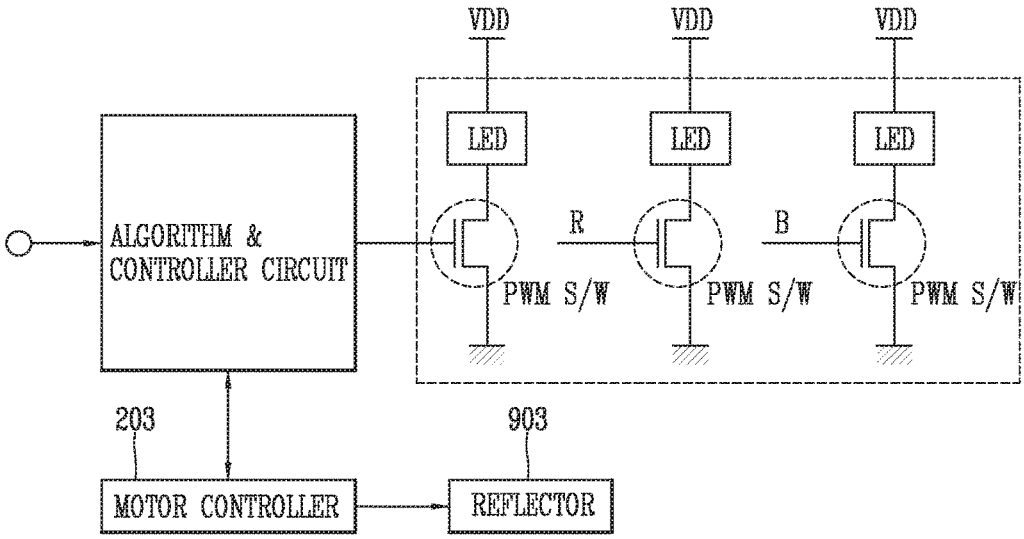
FIGS. 8A and 8B are circuit block diagrams for explaining a driving method of a light emitting unit.
Figure 8B:
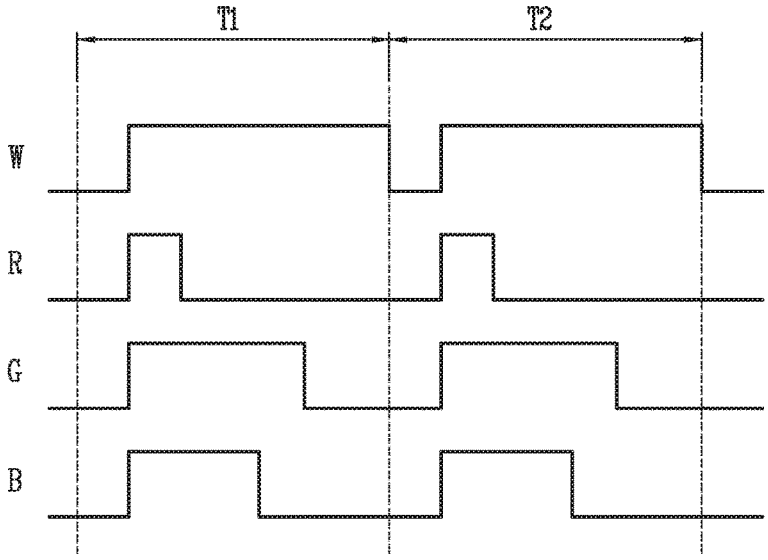

FIGS. 8A and 8B are conceptual views for explaining a driving methods of a light emitting unit for emitting light having a plurality of colors.

As described above, the motor controller interlocks with the control of the light emitting portion 910 (LED) for emitting the plurality of colors while controlling the movement of the reflector 930. For example, a control circuit for controlling the light emitting portion 910 is connected to LEDs that emit red (R), green (G) and blue (B) lights, respectively, to control at least one of the LEDs to be output based on the received control signal.

For example, as illustrated in FIG. 8B, the control circuit may control each light emitting portion 910 to emit each color light during a preset period of time based on an input control signal and a predesigned algorithm. Accordingly, the light emitting unit may emit various lights with various intensities and various time intervals. Furthermore, each light emitting device may be independently controlled from each other, thereby implementing various light emitting forms using the driving method.

According to an embodiment of the present disclosure, the light emitting unit may emit light in various forms based on the driving condition of the main body using the structures and driving methods thereof, and hereinafter, a light emitting form according to the driving condition will be described.

FIGS. 9A through 9E are conceptual views for explaining a light emitting form in the second and the third driving condition. The control unit 200 senses a direction in which the main body moves and control the light, emitting unit 900 based on the moving direction. In other words, the control unit 200 may control the light emitting unit 900 to emit light in various forms according to a second driving condition in which the main body moves in one direction, a third driving condition in which the main body rotates in one direction (clockwise direction or counter-clockwise direction), and a fourth driving condition in which the main body moves while rotates.

Figure 9A:
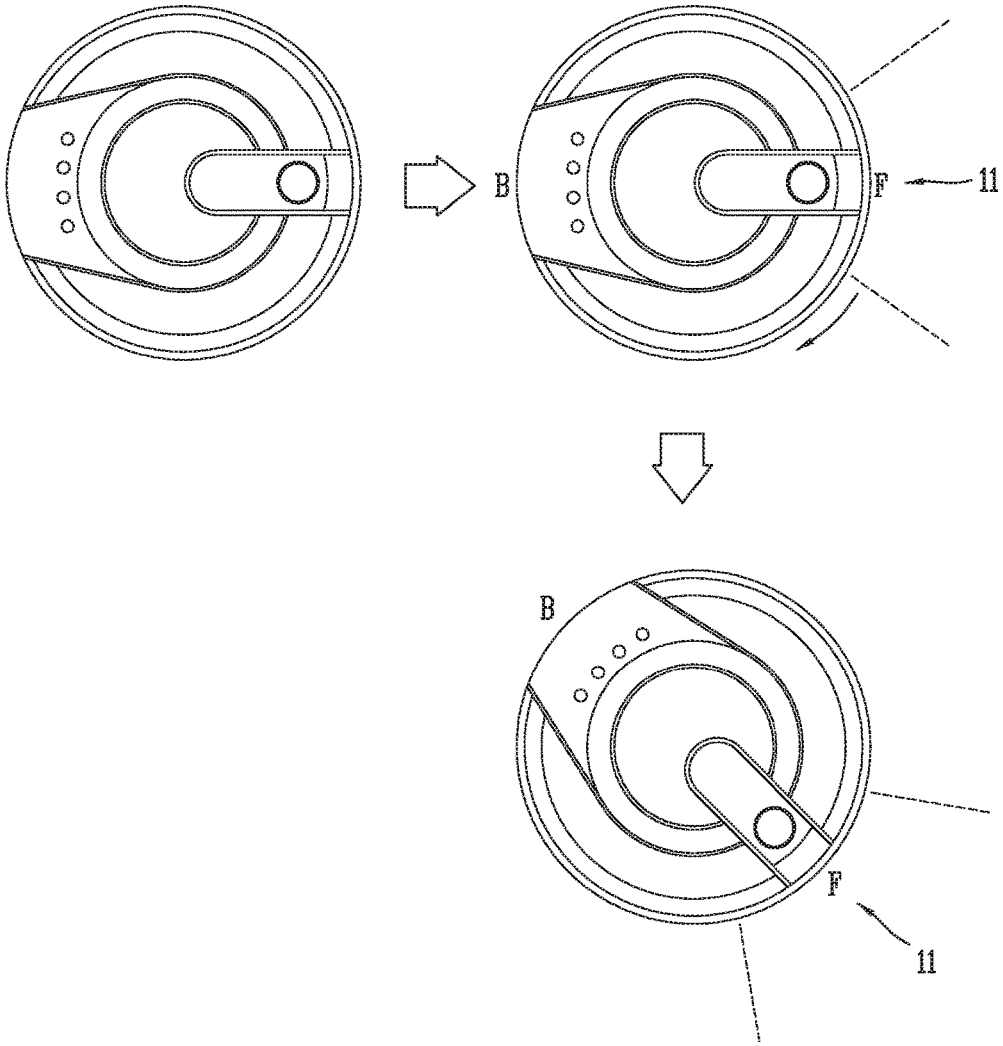
FIGS. 9A through 9E are conceptual views for explaining a driving method of a light emitting unit according to a second and a third driving condition of a robot cleaner.

Referring to FIG. 9A, the control unit 200 defines the main body as a front portion (F) and a rear portion (B) according to a direction in which the main body moves. The direction in which the main body moves includes both a linear motion of the main body and a direction in which the defined front portion (F) moves forward. Furthermore, the main body may perform accelerated motion or, uniform motion in the direction, in which the defined front portion (F) moves forward.

The control unit 200 may control the light emitting unit 900 to emit light to a region adjacent to the front portion (F). In other words, the control unit 200 activates only a light emitting device mounted in a region defined as the front portion (F) of the plurality of light emitting devices. When a moving direction in which the main body moves is changed (in other words, a direction in which the front portion (F) moves forward is changed), the control unit 200 may control the light emitting unit 900 to continuously emit light from the front portion (F).

Accordingly, a user may check a region in which the robot cleaner moves while operating as well as a location of the robot cleaner, and know the status of a region into which the robot cleaner is to be moved in advance.

Figure 9B:
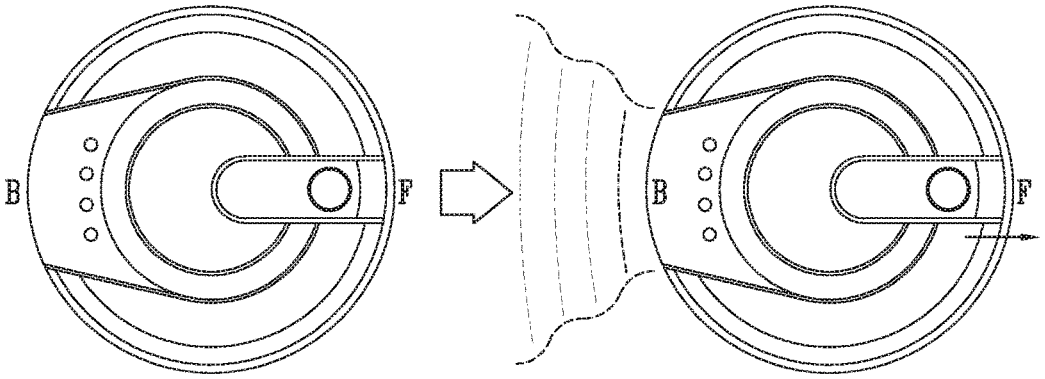

Referring to FIG. 9B, the control unit 200 may control the light emitting unit 900 to emit light from a region defined as the rear portion (B). The rear portion (B) is defined as a region facing the front portion (F) on the main body. The rear portion (B) corresponds to a region in a direction opposite to a direction in which the main body moves, and when moving in a direction opposite to a direction in which the main body moves, the rear portion (B) becomes the front portion (F).

The control unit 200 controls the light emitting unit 900 to activate a light emitting device located in a region adjacent to the rear portion (B). Furthermore, the control unit 200 controls the light emitting unit 900 to emit light in a wave shape to a region adjacent to the rear portion (B). For example, the control unit 200 may change the brightness of the light at preset time intervals (for example, several seconds) to implement light in the wave shape.

Accordingly, a user may check the location and status of a region in which the robot cleaner moves, and light with a wave shape may be emitted, thereby providing clean aesthetics on the cleaned region for the user.

Figure 9C:
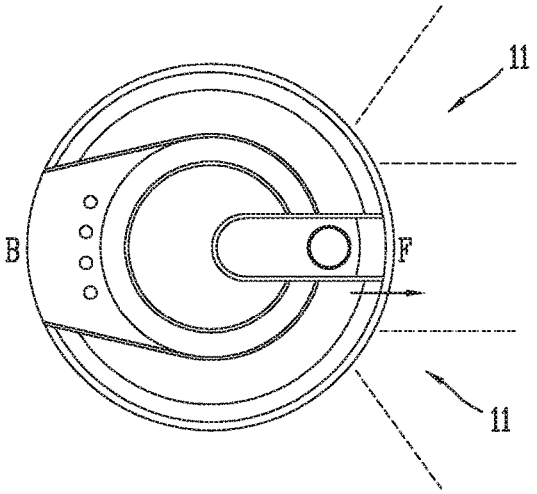

Referring to FIG. 9C, the light emitting unit 900 may activate, light emitting devices separated from one another at the same time. For example, the control unit 200 may activate two light emitting devices adjacent to the front portion (F), and control the light emitting unit 900 to form two light emitting regions configured to surround the front portion (F). Accordingly, light may be transmitted to a surrounding region in which the main body moves.

However, the separated light emitting devices that emit light may not be necessarily limited to this the second and the third driving condition. For example, even in the first driving condition in which the main body stops, the control unit 200 may activate a plurality of light emitting devices disposed to be separated from one another.

Figure 9D:
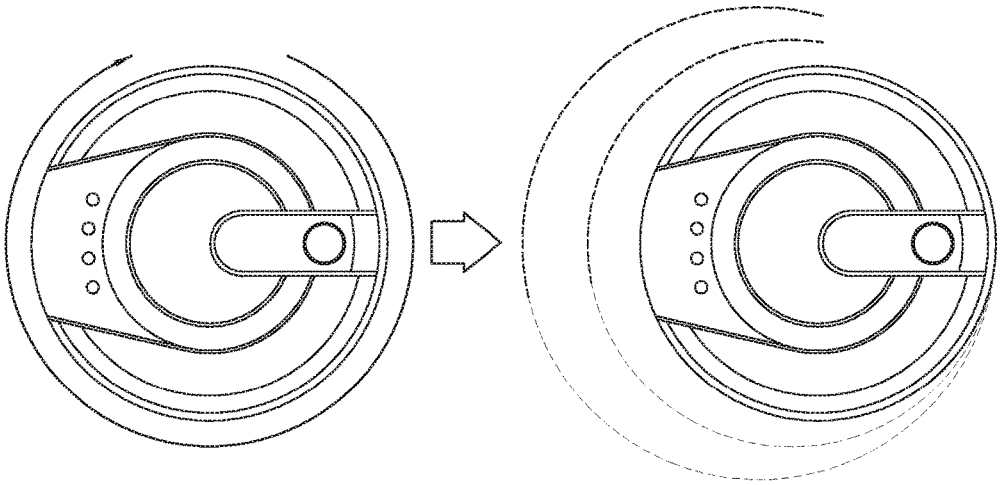

A driving method of the light emitting unit in the third driving condition will be described with reference to FIGS. 9D and 9E. As illustrated in FIG. 9D, when the main body rotates in one direction, the light emitting unit 900 emits light in a tornado shape. For example, when the main body rotates one cycle, the tornado shape is generated from a preset start time point and formed in a shape of surrounding an outer circumference of the main body. For example, when the main body rotates in a rotation speed larger than a preset reference rotation speed, the control unit 200 may control the light emitting unit 900 to emit light in the tornado shape.

Figure 9E:
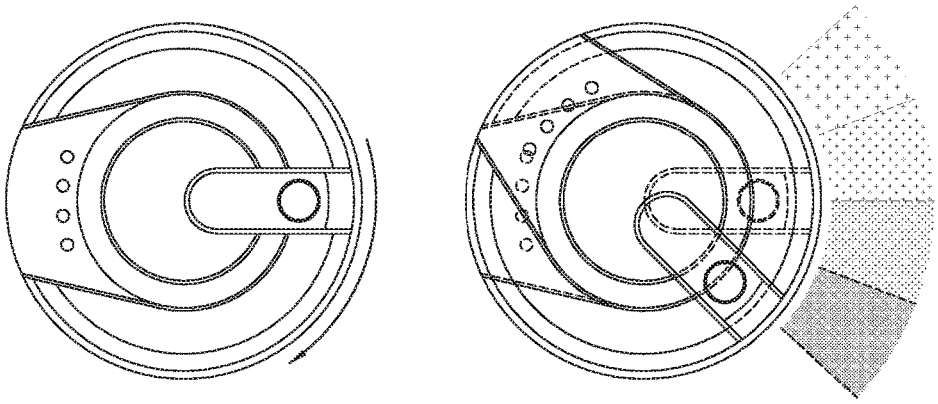

On the other hand, referring to FIG. 9E, when the main body rotates in a rotation speed less than a preset reference rotation speed, the control unit 200 may control the light emitting unit 900 to consecutively activate the plurality of light emitting devices in correspondence to a level at which the main body rotates based on a light emitting device adjacent to a preset start time point so as to sequentially transmit light along an outer circumference of the main body.

For example, a light emitting device adjacent to the start time point may continuously emit light at a first intensity based on the rotation speed, and a plurality of sequentially disposed light emitting devices may emit light at an intensity gradually decreased compared to the first intensity.

Accordingly, a user may sense the rotation status and rotation direction of the main body.

Figure 10A:
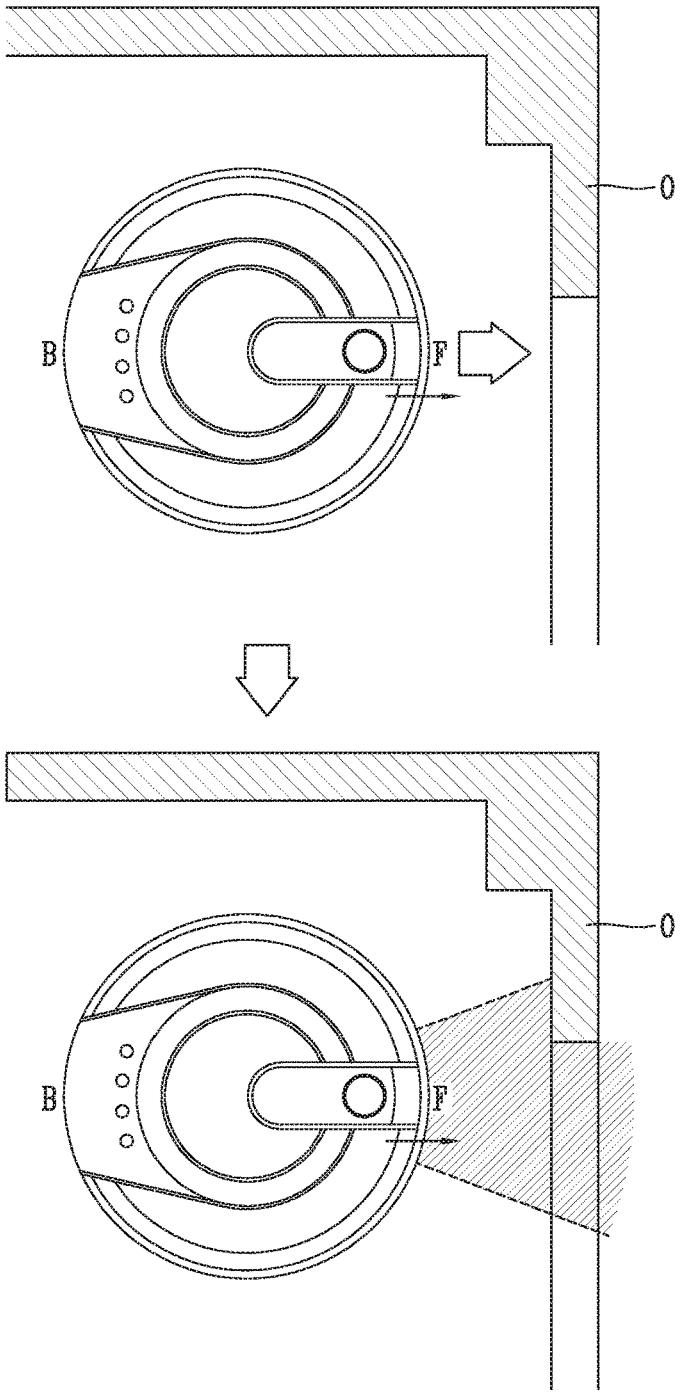
FIGS. 10A and 10B are conceptual views for explaining a driving method of a light emitting unit according to a first driving condition of a robot cleaner.
Figure 10B:
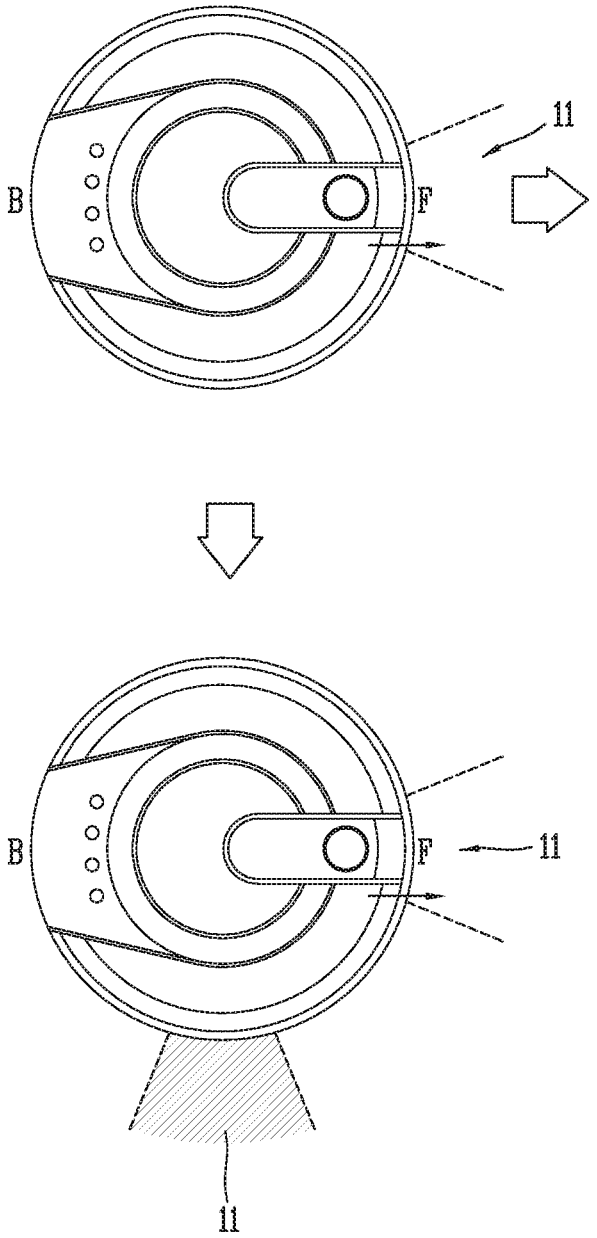

FIGS. 10A and 10B are conceptual views for explaining a driving method of a light emitting unit according to various embodiments.

A driving method of the light emitting unit 900 when an obstacle (O) is sensed will be described with reference to FIG. 10A. The control unit 200 defines the front portion (F) and the rear portion (B) of the main body based on a moving direction of the main body. When the obstacle is sensed by the obstacle sensor (or front sensor) or the like, the control unit 200 activates a light emitting device mounted in a region adjacent to the sensed obstacle.

For example, when an obstacle is sensed in a region adjacent to the front portion (F), the control unit 200 activates a light emitting device in a region adjacent to the front portion (F). Otherwise, the control unit 200 may activate a light emitting device in a region adjacent to the front portion (F) and an additional light emitting device for transmitting light to the obstacle (O) at the same time.

Accordingly, the user may get to know an obstacle sensed in a region in which the main body moves, and when the robot cleaner moves in a dark area, it may be possible to prevent a collision between the robot cleaner and the obstacle.

Referring to FIG. 10B, when an error occurs on each component constituting the robot cleaner, the control unit 200 controls the light emitting unit to it light in one region.

For example, in the second driving condition, the control unit 200 controls the light emitting unit 900 in such a manner that a light emitting device adjacent to the front portion (F) emits light. When an error occurs on part of the detection unit 100 while light is provided from the front portion (F) to the tight emitting region 11, the control unit 200 activates part of the plurality of light, emitting devices. The activated light emitting device corresponds to a light emitting device mounted in the vicinity of the detection unit 100 on which the error has occurred.

However, the light emitting unit 900 may emit light to notify the error even in the first and the second driving condition as well as in the second driving condition. Furthermore, light emitted based on the driving condition may be distinguished from light emitted based on the error.

Furthermore, when at least one component in which a component requiring replacement is sensed or charging as well as a component in which an error occurs is sensed, the control unit 200 controls the light emitting unit 900 to activate a light emitting device which is the closest to each component.

Accordingly, a user may find an error that has occurred while the robot cleaner is driven in a more easy manner.

FIGS. 11A through 11G are conceptual views for explaining a driving method of a light emitting unit that emits light based on a driving condition.

Figure 11A:
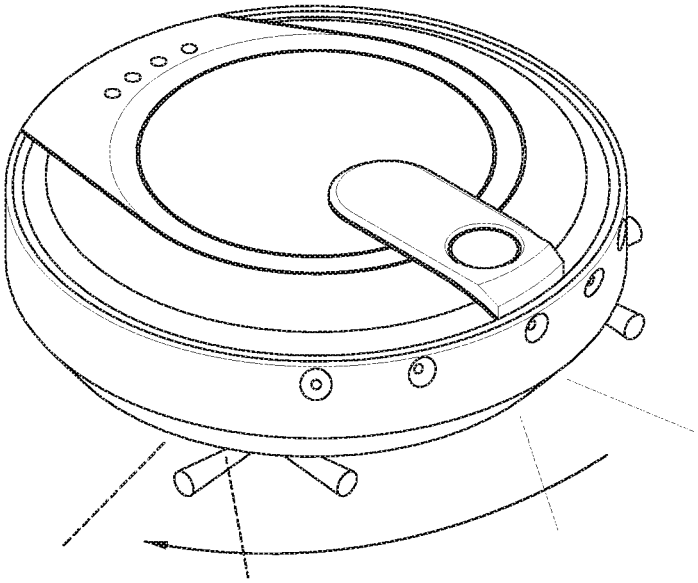
FIGS. 11A through 11G are conceptual views for explaining a driving method of a light emitting unit various embodiments.

Referring to FIG. 11A, the control unit 200 may control light to be emitted along an outer circumferential surface of the main body using a plurality of light emitting devices constituting the light emitting unit 900. In other words, each light emitting device sequentially disposed on the light emitting unit 900 is controlled to be sequentially turned on and off. For example, the light emitting unit 900 is driven to emit light along the outer circumferential surface in a searchlight shape.

For example, the control unit 200 may control the light emitting unit 908 to emit light along the outer circumferential surface while sensing dust or the like on a circumferential surface of the main body just prior to executing a reserved driving set by a user.

Figure 11B:
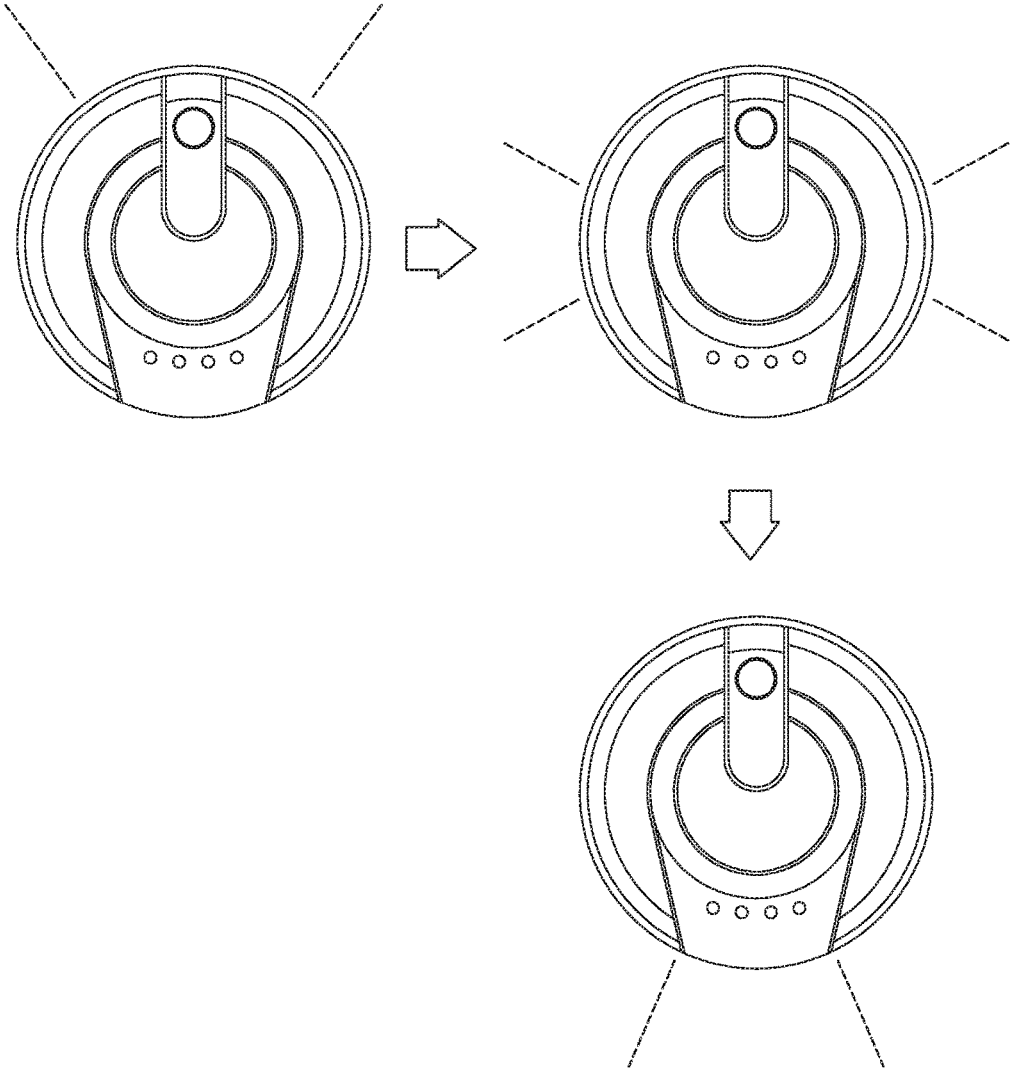

Referring to FIG. 11B, the control unit 200 controls the light emitting unit 900 to emit light along one direction crossing the main body. For example, the control unit 200 controls the light emitting unit 900 to allow light to be consecutively formed on the light emitting region 11 from the front portion to the rear portion of the main body. Accordingly, a user may receive an aesthetic sense in which the robot cleaner seems to search a lower end portion of the main body.

Figure 11C:
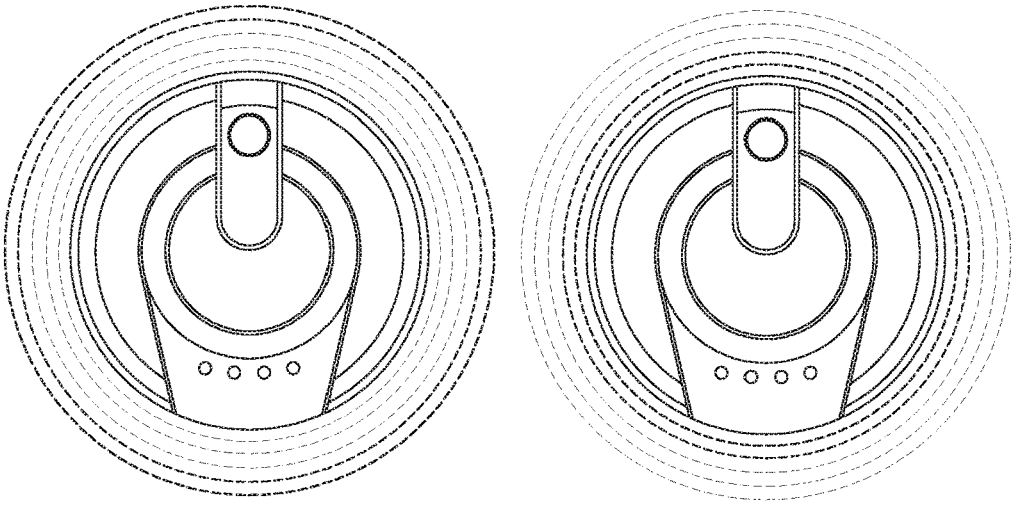
Figure 11D:
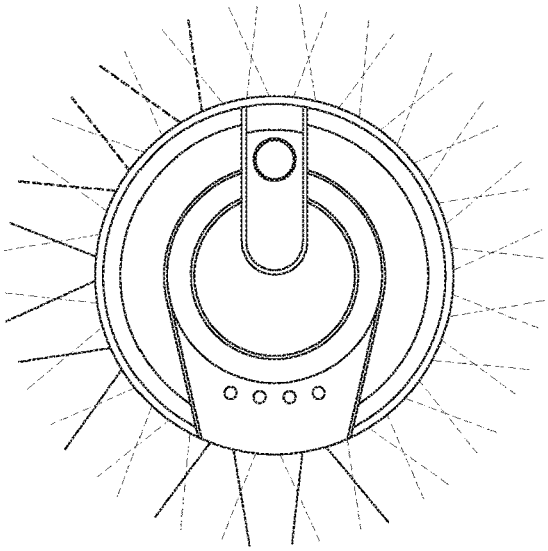
Figure 11E:
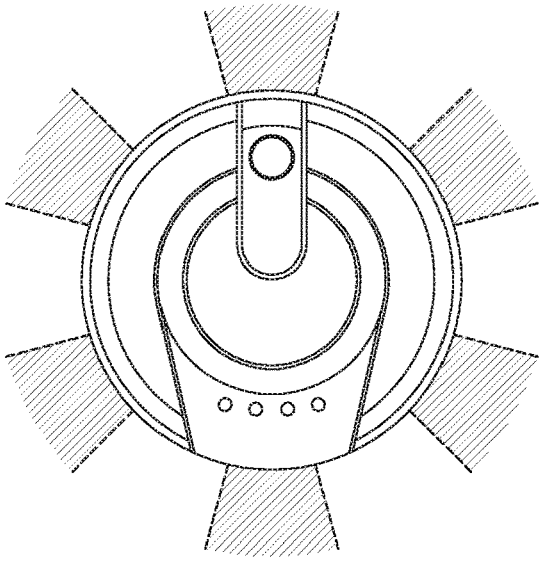

Referring to FIG. 11C, the control unit 200 controls the light emitting unit 900 to emit light in a shape corresponding to a shape of the outer circumference surface in the first through the third driving condition. The light emitting unit 900 emits light in a shape (divergence) in which the light is transmitted from a region close to the outer circumferential surface toward an outside or in a shape (convergence) in which the light is transmitted from a distant region to the outer circumferential surface. In other words, the light emitting unit 900 may emit light in a wave shape. For example, when the robot cleaner is being charged in a state of being stopped, the control unit 200 controls the light emitting unit 900 to emit light in a shape illustrated in the drawing.

For example, a plurality of light emitting devices in the light emitting unit 900 may emit light having a different brightness according to a preset time interval, thereby implementing the foregoing shape. Accordingly, the present disclosure may provide an aesthetic sense in which a robot cleaner seems to take a breath or an aesthetic sense in which the robot cleaner seems to such dust or the like to a user.

Referring to FIG. 10D, the light emitting unit 900 may emit light to allow light containing different colors to surround the outer circumferential surface or emit light only to one region of the outer circumferential surface using light emitting devices separated from one another.

Figure 11F:
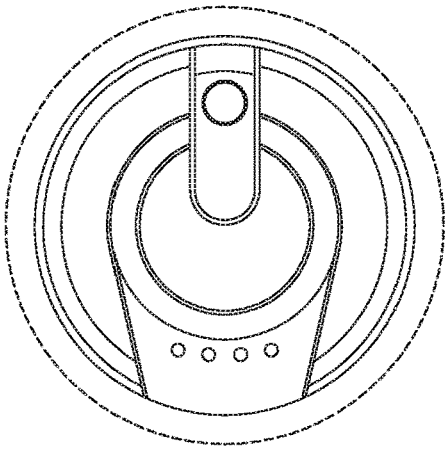

As illustrated in FIG. 11F, the light emitting unit 900 may form light in a band shape formed in a region separated from the outer circumferential surface using the brightness or color of the emitted light.

Figure 11G:
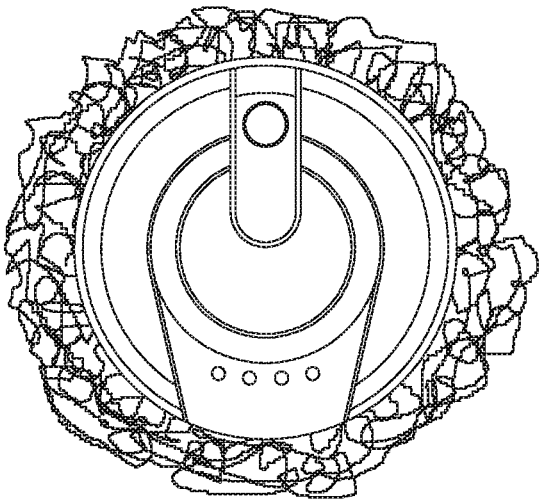

Referring to FIG. 11G, the light emitting unit 900 may provide light in a shape that seems to be scribbled with a pencil to surround the outer circumferential surface using the brightness or color of the emitted light. Furthermore, though not shown in the drawing in detail, the output unit 400 may output an audio effect while, providing the light. For example, the output unit 400 may output an audio effect that seems to be scribbled with a pencil while outputting light in a scribble shape.

According to the present disclosure, a light emitting unit may provide light configured with a different form and color based on a driving condition of the main body, thereby allowing a user to know a driving condition of the robot cleaner using light. Furthermore, the light emitting unit may provide light to a surrounding region of the main body, thereby allowing a user to sense the surrounding condition of the robot cleaner.

Furthermore, the present disclosure may provide an aesthetic sense that seems to have a life for a robot cleaner that automatically moves without a user's control command by light with various patterns transmitted to an outside of the main body.

The configurations and methods according to the above-described embodiments will not be limited to the foregoing robot cleaner, and all or part of each embodiment may be selectively combined and configured to make various modifications thereto.

The present embodiments may control a robot cleaner capable of emitting light according to a main body being moved, and thus may be applicable to various industrial fields.

What is claimed is:

1. A robot cleaner, comprising:

a main body configured to form an outer appearance;

a driving unit configured to move the main body;

a cleaning unit provided at a lower portion of the main body to suck foreign substances on a floor surface or in the air;

a plurality of light emitting units provided at a lower portion of the main body, and formed to emit light to an outside according to a driving condition of the driving unit; and a controller configured to control the plurality of light emitting units to emit light in a different form according to a first driving condition in which the main body stops, a second driving condition in which the main body moves, and a third driving condition in which the main body rotates, respectively, a plurality of detection units mounted on the main body to sense an external object at the outside, wherein the controller determines the driving condition of the plurality of detection units, and when an error occurs in the driving condition of the detection unit, the controller activates a light emitting unit disposed adjacent to the detection unit.

2. The robot cleaner of claim 1, wherein each of the light emitting units comprises:

a light emitting portion formed to emit at least one color light by the controller;

a support portion formed to surround the light emitting portion, and formed of a transparent material to transmit the light therethrough; and a reflector formed in a partial region of an inner surface of the support portion to have an opening portion to reflect light toward a lower portion thereof.

3. The robot cleaner of claim 2, wherein an angle between both ends of the opening portion around the light emitting portion is formed to be less than 90 degrees.

4. The robot cleaner of claim 3, wherein an angle between a first line connecting from the light emitting portion to one end of the opening portion and the ground that supports the main body is formed to be greater than 90 degrees.

5. The robot cleaner of claim 4, wherein an angle between a second line connecting from the light emitting portion to the other end of the opening portion and the ground that supports the main body is formed to make a preset angle.

6. The robot cleaner of claim 2, wherein the plurality of light emitting portions are formed along an outer circumference of the main body, and the controller defines a direction in which the main body moves in the second driving condition as a front portion and a region separated from the front portion as a rear portion, and the controller activates a light emitting portion formed in at least one region of the front portion and the rear portion.

7. The robot cleaner of claim 2, wherein the plurality of light emitting portions are formed along an outer circumference of the main body, and the controller defines one of the plurality of light emitting portions as a reference light emitting unit in the second condition, and sequentially activates the light emitting portions along the one direction from the reference light emitting portion.

8. The robot cleaner of claim 2, wherein the controller controls the light emitting unit to change a brightness of light emitted from the light emitting unit according to the flow of time.

9. The robot cleaner of claim 8, wherein the controller controls the plurality of light emitting units to emit light formed in a predetermined pattern in any one of the first through the third driving condition.

10. The robot cleaner of claim 9, wherein the predetermined pattern is formed in a wave shape moving in a direction away from or closer to an outer circumference of the main body.

11. The robot cleaner of claim 2, further comprising:

a sensing unit configured to sense an obstacle applied to the main body, wherein when an obstacle according to the movement of the main body is sensed, light emitting units disposed at the front portion are activated.

12. The robot cleaner of claim 3, wherein the controller moves the reflector along an inner surface of the support portion to change a region on which the light is reflected.

13. The robot cleaner of claim 4, wherein the reflector comprises a plurality of reflective members formed along an outer circumferential surface of the main body, and the controller controls the plurality of reflective members to move to different positions based on the driving condition.

14. The robot cleaner of claim 4, wherein the light emitting portion comprises a plurality of light emitting members formed along the reflector, and the controller activates the plurality of light emitting members in different manners based on the driving condition.

* * * * *